US011058177B2

(12) United States Patent
Klug et al.

(10) Patent No.: US 11,058,177 B2
(45) Date of Patent: Jul. 13, 2021

(54) FOOTWEAR GROUND ENGAGING MEMBERS HAVING CONCAVE PORTIONS

(71) Applicant: NIKE, Inc., Beaverton, OR (US)

(72) Inventors: Bryant Russell Klug, Beaverton, OR (US); Tetsuya T. Minami, Portland, OR (US); James Molyneux, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 178 days.

(21) Appl. No.: 16/167,166

(22) Filed: Oct. 22, 2018

(65) Prior Publication Data

US 2019/0053573 A1 Feb. 21, 2019

Related U.S. Application Data

(62) Division of application No. 14/145,513, filed on Dec. 31, 2013, now Pat. No. 10,123,588.

(51) Int. Cl.
*A43B 13/26* (2006.01)
*A43B 5/00* (2006.01)
(Continued)

(52) U.S. Cl.
CPC ..... *A43B 13/26* (2013.01); *A43B 5/00* (2013.01); *A43B 13/223* (2013.01);
(Continued)

(58) Field of Classification Search
None
See application file for complete search history.

(56) References Cited

U.S. PATENT DOCUMENTS 1,985,775 A 12/1934 Goldenberg
D99,934 S 6/1936 Fowler
(Continued)

FOREIGN PATENT DOCUMENTS

EP 2499928 A1 * 9/2012 ..... A43C 15/162
FR 1216016 A 4/1960
(Continued)

OTHER PUBLICATIONS

European Patent Office, Extended EP Search Report for EP Application No. 19181317.9, dated Dec. 10, 2019.
(Continued)

*Primary Examiner* — Jila M Mohandesi
(74) *Attorney, Agent, or Firm* — Honigman LLP; Matthew H. Szalach; Jonathan O'Brien

(57) ABSTRACT

An article of footwear may include a first ground engaging member extending substantially downward from a baseplate, the first ground engaging member may have a substantially triangular cross-sectional shape in a substantially horizontal plane, the first ground engaging member having a first sidewall edge, a second sidewall edge, and a third sidewall edge forming vertices of the substantially triangular cross-sectional shape. In addition, a first sidewall may have a concave portion that is concave in the substantially horizontal plane. Further, the first ground engaging member may be disposed proximate a peripheral edge of the outer member with the first sidewall edge disposed opposite the concave portion of the sidewall, and the first sidewall edge oriented facing toward the peripheral edge. Also, the concave portion of the first sidewall may be oriented in a substantially lateral direction, facing away from the peripheral edge of the outer member.

20 Claims, 13 Drawing Sheets

(51) Int. Cl.
*A43C 15/16* (2006.01)
*A43B 13/22* (2006.01)

(52) U.S. Cl.
CPC ..... *A43C 15/161* (2013.01); *A43C 15/162* (2013.01); *A43C 15/167* (2013.01)

(56) References Cited

U.S. PATENT DOCUMENTS

| | | | | |
|---|---|---|---|---|
| 2,510,560 | A | 6/1950 | Daniels | |
| 2,580,840 | A | 1/1952 | Rikard | |
| 2,745,197 | A * | 5/1956 | Holt | A43C 15/165 36/127 |
| 2,888,756 | A | 6/1959 | Neal | |
| 2,888,758 | A | 6/1959 | Allin | |
| 3,103,075 | A | 9/1963 | Paulding | |
| 3,127,687 | A | 4/1964 | Hollister | |
| 3,341,952 | A | 9/1967 | Dassler | |
| 3,352,034 | A * | 11/1967 | Braun | A43C 15/162 36/67 D |
| 3,656,245 | A | 4/1972 | Wilson | |
| 3,859,739 | A | 1/1975 | Dassler | |
| 4,107,858 | A | 8/1978 | Bowerman et al. | |
| D256,180 | S | 8/1980 | Turner | |
| D264,017 | S | 4/1982 | Turner | |
| D266,967 | S | 11/1982 | Inohara | |
| 4,393,604 | A | 7/1983 | Crowley | |
| D272,772 | S | 2/1984 | Kohno | |
| 4,527,344 | A | 7/1985 | Mozena | |
| 4,586,274 | A * | 5/1986 | Blair | A43C 13/04 36/114 |
| D290,782 | S | 7/1987 | Grubel | |
| D313,112 | S | 12/1990 | Eisenbach | |
| D322,355 | S | 12/1991 | Arai | |
| 5,201,126 | A | 4/1993 | Tanel | |
| D339,459 | S | 9/1993 | Yoshikawa et al. | |
| D351,495 | S | 10/1994 | Nagai et al. | |
| 5,473,827 | A | 12/1995 | Barre et al. | |
| 5,555,650 | A | 9/1996 | Longbottom et al. | |
| D376,683 | S | 12/1996 | Gaudio et al. | |
| 5,709,954 | A | 1/1998 | Lyden et al. | |
| 5,720,117 | A | 2/1998 | Toschi | |
| 5,832,636 | A | 11/1998 | Lyden et al. | |
| D404,191 | S | 1/1999 | Harada et al. | |
| D408,619 | S | 4/1999 | Worthington et al. | |
| 6,018,893 | A | 2/2000 | Workman | |
| D437,989 | S | 2/2001 | Cass | |
| 6,186,000 | B1 | 2/2001 | Kaneko et al. | |
| 6,357,146 | B1 * | 3/2002 | Wordsworth | A43C 15/16 36/128 |
| 6,421,933 | B1 | 7/2002 | Zamprogno | |
| 6,499,235 | B2 | 12/2002 | Lussier et al. | |
| 6,637,132 | B2 | 10/2003 | Gerrand | |
| 6,705,027 | B1 | 3/2004 | Campbell | |
| 6,810,605 | B2 | 11/2004 | Nakano et al. | |
| 6,826,852 | B2 | 12/2004 | Fusco | |
| 6,904,707 | B2 * | 6/2005 | McMullin | A43C 15/162 36/127 |
| 6,954,998 | B1 | 10/2005 | Lussier | |
| 6,959,505 | B2 | 11/2005 | Poe | |
| 6,973,745 | B2 | 12/2005 | Mills et al. | |
| 7,086,183 | B2 | 8/2006 | Wood et al. | |
| D541,017 | S | 4/2007 | McClaskie | |
| D547,037 | S | 7/2007 | Nakano | |
| D556,989 | S | 12/2007 | Horne et al. | |
| 7,347,011 | B2 | 3/2008 | Dua et al. | |
| 7,428,790 | B2 | 9/2008 | Pellerin | |
| 7,823,301 | B2 | 11/2010 | Belluto | |
| 8,206,630 | B2 | 6/2012 | Sussmann et al. | |
| 8,215,035 | B2 | 7/2012 | Mills et al. | |
| D675,415 | S | 2/2013 | Minami | |
| 8,453,354 | B2 | 6/2013 | Baker | |
| D688,037 | S | 8/2013 | Dekovic et al. | |
| D717,034 | S | 11/2014 | Bramani | |
| 2002/0174571 | A1 | 11/2002 | Briant et al. | |
| 2003/0093926 | A1 | 5/2003 | Auger et al. | |
| 2006/0021259 | A1 | 2/2006 | Wood et al. | |
| 2006/0042124 | A1 | 3/2006 | Mills et al. | |
| 2008/0098624 | A1 | 5/2008 | Goldman | |
| 2009/0100718 | A1 | 4/2009 | Gerber | |
| 2010/0212190 | A1 | 8/2010 | Schmid | |
| 2011/0035963 | A1 | 2/2011 | Baker et al. | |
| 2011/0088285 | A1 | 4/2011 | Dojan et al. | |
| 2011/0197475 | A1 | 8/2011 | Weidl et al. | |
| 2011/0247237 | A1 | 10/2011 | Jara et al. | |
| 2012/0011744 | A1 | 1/2012 | Bell et al. | |
| 2012/0066933 | A1 | 3/2012 | Meythaler | |
| 2012/0198720 | A1 | 8/2012 | Farris et al. | |
| 2013/0067772 | A1 | 3/2013 | Auger et al. | |
| 2013/0067776 | A1 | 3/2013 | Auger et al. | |
| 2013/0067778 | A1 | 3/2013 | Minami | |
| 2013/0185960 | A1 | 7/2013 | Schmid | |
| 2014/0026441 | A1 | 1/2014 | Stauffer | |

FOREIGN PATENT DOCUMENTS

| | | | | |
|---|---|---|---|---|
| GB | 2020161 | A | 11/1979 | |
| JP | H10-066605 | A | 3/1998 | |
| JP | 2002-272506 | A | 9/2002 | |
| WO | WO-03/045182 | A1 | 6/2003 | |
| WO | WO-03045182 | A1 * | 6/2003 | A43B 5/02 |

OTHER PUBLICATIONS

Brazilian Industrial Property Office, Search Report for BR Application No. 112016015466-5, dated Apr. 28, 2020.
Australian Government, IP Australia, Examination report No. 1 for standard patent application for Application No. 2014374357, dated Jan. 24, 2017.
State Intellectual Property Office, Office Action for CN Application No. 201480076633.9, dated Feb. 8, 2018.
International Searching Authority, International Search Report and Written Opinion dated Feb. 4, 2015 in PCT/US2014/063084.
State Intellectual Property Office, Office Action for CN Application No. 201480076633.9, dated May 25, 2017.
U.S. Appl. No. 61/655,215, filed Jan. 22, 2013.
USPTO, Non-Final Office Action for U.S. Appl. No. 14/145,513 dated Jan. 9, 2018.
USPTO, Final Office Action for U.S. Appl. No. 14/145,513 dated May 30, 2017.
USPTO, Non-Final Office Action for U.S. Appl. No. 14/145,513 dated Jan. 9, 2017.
USPTO, Final Office Action for U.S. Appl. No. 14/145,513 dated Aug. 10, 2016.
USPTO, Non-Final Office Action for U.S. Appl. No. 14/145,513 dated Feb. 25, 2016.

* cited by examiner

FOOTWEAR GROUND ENGAGING MEMBERS HAVING CONCAVE PORTIONS

CROSS REFERENCE TO RELATED APPLICATION

This application is a divisional of U.S. application Ser. No. 14/145,513, filed on Dec. 31, 2013, the contents of which are hereby incorporated by reference in its entirety.

FIELD OF THE INVENTION

The present invention relates generally to a sole structure for an article of footwear and, more particularly, to configurations of ground engaging members.

BACKGROUND

It is advantageous, when participating in various activities, to have footwear that provides traction and stability on the surface upon which the activities take place. Accordingly, sole structures for articles of footwear have been developed with traction systems that include ground engaging members to provide traction on a variety of surfaces. Examples include cleated shoes developed for outdoor sports, such as soccer, football, and baseball. In some cases, the shape and orientation of ground engaging members on a sole structure may be configured particularly for forward and rearward traction.

The present disclosure is directed to improvements in existing sole structure traction systems, including provisions for multi-directional traction to facilitate overall agility.

SUMMARY

In one aspect, the present disclosure is directed to an article of footwear, including an upper configured to receive a foot and a sole structure fixedly attached to a bottom portion of the upper. The sole structure may include a ground engaging outer member including a baseplate having a bottom surface. The outer member may further include at least a first ground engaging member extending substantially downward from the bottom surface of the baseplate to a free end of the first ground engaging member. The first ground engaging member may have a substantially triangular cross-sectional shape in a substantially horizontal plane, the first ground engaging member having a first sidewall edge, a second sidewall edge, and a third sidewall edge forming vertices of the substantially triangular cross-sectional shape. In addition, the first ground engaging member may include a first sidewall having a concave portion that is concave in the substantially horizontal plane. Further, the first ground engaging member may be disposed proximate a peripheral edge of the outer member. The first sidewall edge may be disposed opposite the concave portion of the sidewall, and the first sidewall edge may be oriented facing toward the peripheral edge of the outer member. Also, the concave portion of the first sidewall may be oriented in a substantially lateral direction, facing away from the peripheral edge of the outer member.

In another aspect, the present disclosure is directed to an article of footwear, including an upper configured to receive a foot and a sole structure fixedly attached to a bottom portion of the upper. The sole structure may include a ground engaging outer member including a baseplate having a bottom surface. The outer member may further include at least a first ground engaging member extending substantially downward from the bottom surface of the baseplate to a free end of the first ground engaging member. The first ground engaging member may have a substantially triangular cross-sectional shape in a substantially horizontal plane, the first ground engaging member including a first sidewall having a concave portion that is concave in the first substantially horizontal plane. In addition, the free end of the first ground engaging member may have a substantially planar tip surface in a second substantially horizontal plane, the tip surface having a substantially triangular shape having a perimeter formed by a first tip surface edge, a second tip surface edge, and a third tip surface edge. The first tip surface edge may correspond with the concave portion of the sidewall, and the first tip surface edge may be concave in the second substantially horizontal plane. In addition, the first ground engaging member may be disposed proximate a peripheral edge of the outer member. Also, the first tip surface edge may be oriented facing away from the peripheral edge of the outer member.

In another aspect, the present disclosure is directed to an article of footwear, including an upper configured to receive a foot and a sole structure fixedly attached to a bottom portion of the upper. The sole structure may include a ground engaging outer member including a baseplate having a bottom surface. The outer member may further include at least a first ground engaging member extending substantially downward from the bottom surface of the baseplate to a free end of the first ground engaging member. The first ground engaging member may have a substantially triangular cross-sectional shape in a substantially horizontal plane, the first ground engaging member being disposed proximate a peripheral edge of the outer member. In addition, the first ground engaging member may include a first sidewall having a concave portion that is concave in the first substantially horizontal plane. At least a portion of the concave portion of the first sidewall may be an acute portion, forming an acute angle with the baseplate in a substantially vertical direction. Also, the acute portion of the first sidewall may be oriented facing away from the peripheral edge of the outer member.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The drawings are schematic and, therefore, the components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
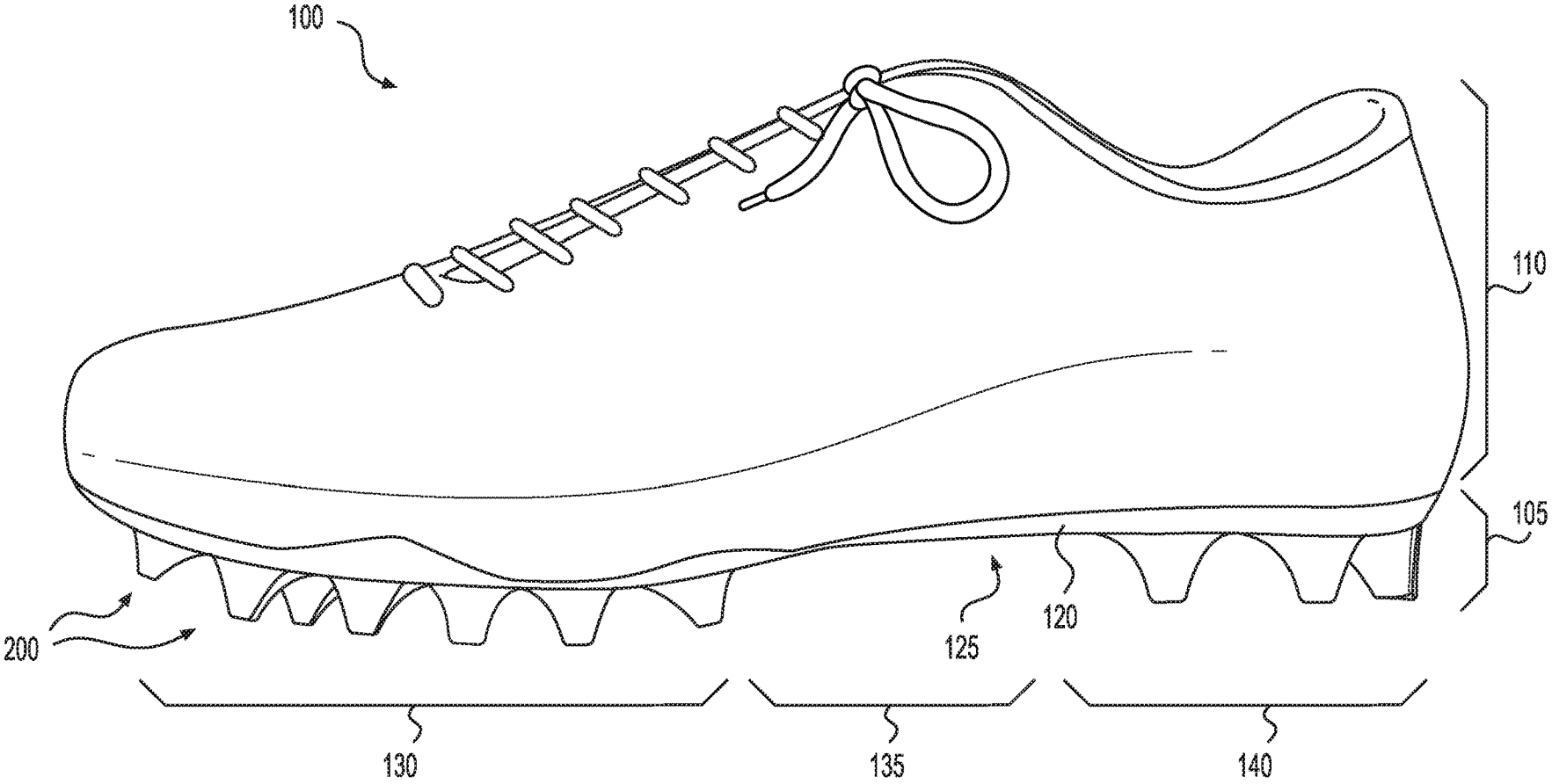
FIG. 1 is a schematic illustration of an exemplary article of footwear having a ground engaging outer member with ground engaging members.

The following discussion and accompanying figures disclose a sole structure for an article of footwear. Concepts associated with the footwear disclosed herein may be applied to a variety of athletic footwear types, including soccer shoes, baseball shoes, football shoes, and golf shoes, for example. Accordingly, the concepts disclosed herein apply to a wide variety of footwear types.

For consistency and convenience, directional adjectives are employed throughout this detailed description corresponding to the illustrated embodiments. The term "longitudinal," as used throughout this detailed description and in the claims, refers to a direction extending a length of a sole structure, i.e., extending from a forefoot portion to a heel portion of the sole. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a sole. In other words, the lateral direction may extend between a medial side and a lateral side of an article of footwear, with the lateral side of the article of footwear being the surface that faces away from the other foot, and the medial side being the surface that faces toward the other foot.

The term "lateral axis," as used throughout this detailed description and in the claims, refers to an axis oriented in a lateral direction.

The term "horizontal," as used throughout this detailed description and in the claims, refers to any direction substantially parallel with the ground, including the longitudinal direction, the lateral direction, and all directions in between. Similarly, the term "side," as used in this specification and in the claims, refers to any portion of a component facing generally in a lateral, medial, forward, and/or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques. In addition, two components may be "fixedly attached" by virtue of being integrally formed, for example, in a molding process.

FIG. 1 depicts an embodiment of an article of footwear 100, which may include a sole structure 105 and an upper 110 configured to receive a foot. Sole structure 105 may be fixedly attached to a bottom portion of upper 110. As shown in FIG. 1 for reference purposes, footwear 100 may be divided into three general regions, including a forefoot region 130, a midfoot region 135, and a heel region 140. Forefoot region 130 generally includes portions of footwear 100 corresponding with the toes and the joints connecting the metatarsals with the phalanges. Midfoot region 135 generally includes portions of footwear 100 corresponding with an arch area of the foot. Heel region 140 generally corresponds with rear portions of the foot, including the calcaneus bone. Forefoot region 130, midfoot region 135, and heel region 140 are not intended to demarcate precise areas of footwear 100. Rather, forefoot region 130, midfoot region 135, and heel region 140 are intended to represent general relative areas of footwear 100 to aid in the following discussion.

Since sole structure 105 and upper 110 both span substantially the entire length of footwear 100, the terms forefoot region 130, midfoot region 135, and heel region 140 apply not only to footwear 100 in general, but also to sole structure 105 and upper 110, as well as the individual elements of sole structure 105 and upper 110. Footwear 100 may be formed of any suitable materials. In some configurations, the disclosed footwear 100 may employ one or more materials disclosed in Lyden et al., U.S. Pat. No. 5,709,954, issued Jan. 20, 1998, the entire disclosure of which is incorporated herein by reference.

Upper 110 may include one or more material elements (for example, textiles, foam, leather, and synthetic leather), which may be stitched, adhesively bonded, molded, or otherwise formed to define an interior void configured to receive a foot. The material elements may be selected and arranged to selectively impart properties such as durability, air-permeability, wear-resistance, flexibility, and comfort. Upper 110 may alternatively implement any of a variety of other configurations, materials, and/or closure mechanisms.

Sole structure 105 may have a configuration that extends between upper 110 and the ground and may be secured to upper 110 in any suitable manner. For example, sole structure 105 may be secured to upper 110 by adhesive attachment, stitching, welding, or any other suitable method. Sole structure 105 may include provisions for attenuating ground reaction forces (that is, cushioning and stabilizing the foot during vertical and horizontal loading). In addition, sole structure 105 may be configured to provide traction, impart stability, and/or limit various foot motions, such as pronation, supination, and/or other motions.

The configuration of sole structure 105 may vary significantly according to one or more types of ground surfaces on which sole structure 105 may be used. For example, the disclosed concepts may be applicable to footwear configured for use on indoor surfaces and/or outdoor surfaces. The configuration of sole structure 105 may vary based on the properties and conditions of the surfaces on which footwear 100 is anticipated to be used. For example, sole structure 105 may vary depending on whether the surface is harder or softer. In addition, sole structure 105 may be tailored for use in wet or dry conditions.

Sole structure 105 may include multiple components, which may individually and/or collectively provide footwear 100 with a number of attributes, such as support, rigidity, flexibility, stability, cushioning, comfort, reduced weight, traction, and/or other attributes. For example, in some embodiments, sole structure 105 may incorporate incompressible plates, moderators, and/or other elements that attenuate forces, influence the motions of the foot, and/or impart stability, for example. Further, while various types of cleated footwear may be provided without a midsole, in some embodiments, sole structure 105 may also include a midsole (not shown) disposed between outer member 120 and upper 110. Such a midsole may include cushioning members, reinforcing structures, support structures, or other features.

An article of footwear according to the present disclosure may include a sole structure including a ground engaging outer member fixedly attached to the bottom portion of the upper. The outer member may include features that provide traction and stability on any of a variety of surfaces, and in any of a variety of conditions. The outer member may include a baseplate and one or more ground engaging members extending downward from the baseplate. The baseplate may include a substantially flat element that supports the foot, and serves as a substantially rigid platform from which the ground engaging members may extend.

As shown in FIG. 1, sole structure 105 may include a ground-contacting outer member 120. Outer member 120 may include a baseplate 145. Baseplate 145 may be a substantially flat, plate-like platform. Baseplate 145, although relatively flat, may include various anatomical contours, such as a relatively rounded longitudinal profile, a heel portion that is higher than the forefoot portion, a higher arch support region, and other anatomical features. In addition, baseplate 145 may include a bottom surface 125 exposed to the ground. Bottom surface 125 may be generally flat, but may have various contours that provide stiffness, strength, and/or traction. Exemplary such structures are discussed in greater detail below.

Outer member 120 may include various features configured to provide traction. For example, in some embodiments, outer member 120 may include one or more ground-engaging members 200 extending from outer surface 125, as shown in FIG. 1.

Materials and configurations for the outer member may be selected according to the type of activity for which footwear 100 is configured. The outer member may be formed of suitable materials for achieving the desired performance attributes. For example, the outer member may be formed of any suitable polymer, rubber, composite, and/or metal alloy materials. Exemplary such materials may include thermoplastic and thermoset polyurethane (TPU), polyester, nylon, glass-filled nylon, polyether block amide, alloys of polyurethane and acrylonitrile butadiene styrene, carbon fiber, poly-paraphenylene terephthalamide (para-aramid fibers, e.g., Kevlar®), titanium alloys, and/or aluminum alloys. In some embodiments, the outer member, or portions of the outer member, may be formed of a composite of two or more materials, such as carbon-fiber and poly-paraphenylene terephthalamide. In some embodiments, these two materials may be disposed in different portions of the outer member. Alternatively, or additionally, carbon fibers and poly-paraphenylene terephthalamide fibers may be woven together in the same fabric, which may be laminated to form the outer member. Other suitable materials, including future-developed materials, will be recognized by those having skill in the art.

Different structural properties may be desired for different aspects of the outer member. Therefore, the structural configuration may be determined such that, even though a common material is used for all portions of the outer member, the different portions may be stiffer, or more flexible due to different shapes and sizes of the components. For example, the heel and midfoot regions of the baseplate may be formed of a thicker material and/or may include reinforcing features, such as ribs, in order to provide stiffness to these portions of the outer member, whereas the forefoot region of the baseplate, particularly a region of the baseplate corresponding with the ball of the foot, may be formed of a relatively thin material, in order to provide flexibility to the forefoot region. Greater flexibility in a forefoot region may enable natural flexion of the foot during running or walking, and may also enable the outer member to conform to surface irregularities, which may provide additional traction and stability on such surfaces. In addition, the ground engaging members may be formed with a thicker structure to provide rigidity and strength.

The outer member may be formed by any suitable process. For example, in some embodiments, the outer member may be formed by molding. In addition, in some embodiments, various elements of the outer member may be formed separately and then joined in a subsequent process. Those having ordinary skill in the art will recognize other suitable processes for making the outer members discussed in this disclosure.

In some embodiments the baseplate, the ground engaging members, and other elements of the outer member may be integrally formed. For example, in some embodiments, the entirety of the outer member may be formed of a single material, forming all parts of the outer member. In such embodiments, the outer member may be formed all at once in a single molding process, for example, with injection molding.

In other embodiments, different portions of the outer member may be formed of different materials. For example, a stiffer material, such as carbon fiber, may be utilized in the heel and/or midfoot regions of the baseplate, whereas a more flexible material, such as a thin polyurethane, may be used to form the forefoot region of the baseplate. In addition, it may be desirable to utilize a stiffer and/or harder material for the baseplate, such as carbon-fiber and/or polyurethane, and softer and more flexible material for the ground engaging members, such as a relatively hard rubber.

Accordingly, in some embodiments, the outer member may be formed by multiple molding steps, for example, using a co-molding process. For instance, the baseplate may be pre-molded, and then inserted into an outer member mold, into which the ground engaging member material may be injected to form the ground engaging members, or portions of the ground engaging members. In other embodiments, the ground engaging members may be pre-molded and the baseplate may be co-molded with the pre-formed ground engaging members. In addition, other components of the baseplate, such as reinforcing elements, may be formed of different materials.

In some embodiments, the baseplate and ground engaging members may be made separately and then engaged with one another (e.g., by mechanical connectors, by cements or adhesives, etc.). In some embodiments, the cleats and outsole components may be integrally formed as a unitary, one piece construction (e.g., by a molding step).

In some embodiments, at least some portions of the sole structure (e.g., outsole components, optionally including a rear heel support or other heel counter type structure) may be affixed to one another or formed together as a unitary, one-piece construction, e.g., by selective laser sintering, stereolithography, or other three dimensional printing or rapid manufacturing additive fabrication techniques. These types of additive fabrication techniques allow the cleats, outsole base plates, matrix structures, support members, heel counters, and/or rear heel supports to be built as unitary structures.

The configuration of sole structure 105 may vary significantly according to one or more types of ground surfaces on which sole structure 105 may be used. Accordingly, outer member 120 may be configured to provide traction on various surfaces, such as natural turf (e.g., grass), synthetic turf, dirt, snow. Sole structure 105 may also vary based on the properties and conditions of the surfaces on which footwear 100 is anticipated to be used. For example, sole structure 105 may vary depending on whether the surface is harder or softer. In addition, sole structure 105 may be tailored for use in wet or dry conditions. In addition, the configuration of sole structure 105, including the traction pattern of outer member 120, may vary significantly according to the type of activity for which footwear 100 is anticipated to be used (for example, running, soccer, baseball, football, and other activities).

In some embodiments, sole structure 105 may be configured for a particularly specialized surface and/or condition. For example, in some embodiments, sole structure 105 may include a sole for a soccer shoe configured to provide traction and stability on soft, natural turf surfaces in wet conditions. In some such embodiments, sole structure 105 may include, for example, a low number of ground engaging members, wherein the ground engaging members are aggressively shaped, and have a relatively large size. Conversely, an alternative embodiment of sole structure 105 may be configured to provide traction and stability on relatively firm, artificial turf surfaces in dry conditions. In some such embodiments, sole structure 105 may include, for example, a larger number of ground engaging members, which may be relatively smaller in size, and may have less aggressive shapes. While the number, size, and shape of ground engaging members are provided for exemplary purposes, other structural parameters may be varied in order to tailor the shoe for traction and stability on various surfaces, and/or in a variety of conditions. Additional such parameters may include, for example, the use of secondary traction elements, placement of ground engaging members, the relative softness or hardness of the ground engaging members and/or sole structure 105 in general, the relative flexibility of portions of sole structure 105, and other such parameters.

In some embodiments, sole structure 105 may be configured for versatility. For example, sole structure 105 may be configured to provide traction and stability on a variety of surfaces, having a range of properties, and/or under various conditions. For example, a versatile embodiment of sole structure 105 may include a medium number of ground engaging members, having a medium size and moderately aggressive shapes.

In addition to surface properties and conditions, sole structure 105 may also be configured based on the physical characteristics of the athlete anticipated to wear the footwear, and/or according to the type of activity anticipated to be performed while wearing the footwear. Football players, depending on the position they play, can have a wide range of physical characteristics and abilities. For example, linemen may be relatively heavy, relatively slower, but also much more powerful than players who play other positions. Linemen may place larger loads on a sole structure that may be sustained over longer durations, for example, up to one or two seconds, while engaging with opposing linemen.

In contrast, skilled player positions, such as wide receivers, may be relatively lighter weight, but much faster. Skilled player positions, may place more explosive and transient loads on a sole structure, via sprinting, cutting, and jumping, and thus, may also maintain those loads for only a relatively short duration (for example, a split second). Linebackers may have physical characteristics and abilities that represent a combination of the physical traits and abilities of linemen and wide receivers. While linebackers may possess speed and agility and operate in open field like a wide receiver, linebackers may also be larger, heavier, and more powerful, and also engage other players in tackling/blocking situations, like a lineman.

In view of the differing demands linemen and wide receivers may place on sole structures, sole structures most suitable for each type of player may be configured differently. For example, the sole structures of linemen shoes may be configured to be more stiff and durable, and also to distribute loads across the sole of the shoe. In contrast, wide receiver shoes may have sole structures that are configured for light weight, more selective flexibility and stiffness at different areas of the foot, fast ground penetration and egress by ground engaging members, and lateral responsiveness. Further, a sole structure configured for use by a linebacker may be more versatile, possessing compromises of strength, stiffness, stability, light weight, directional traction, and other characteristics.

Other types of activities may place similar and/or different demands on a sole structure of a shoe. For example, soccer athletes may place similar demands as wide receivers, that is, loads based on speed and agility. Thus, sole structures having light weight, responsiveness, fast ground penetration and egress, and traction in a variety of directions and at a variety of ground contact angles may be advantageous. In other sports, the demands may be more focused. For example, sole structures configured for use by track and field sprinters, who only run in a straight line at high speeds and accelerations, may be configured for light weight, straight line traction, and fast surface penetration and egress.

In some embodiments, the disclosed footwear may be configured for activities involving multi-directional agility. For example, the disclosed footwear may be configured for agility training and evaluation. In some embodiments, the disclosed footwear may be configured for agility testing, such as the NFL combine or other pre-draft or pre-season speed and agility evaluations.

Agility testing involves short, timed activities that athletes perform in order to test their athletic ability. In contrast to activities such as the 40 yard dash, which tests speed and acceleration in a straight line, agility testing evaluates an athlete's ability to accelerate, decelerate, and change directions. Further, agility testing evaluates an athlete's ability to move not only forward, but also laterally.

An athlete's ability to demonstrate agility is dependent on multi-directional traction between the athlete's footwear and the ground surface upon which the exercise is performed. If traction is lacking and the athlete slips during a change of direction, the change of direction cannot be performed as quickly. By providing traction in multiple directions, a shoe configured for agility may enable athlete to perform to the peak of their athletic potential, because traction will not be a limiting factor, or will be less limiting than a shoe not so configured.

The accompanying figures depict various embodiments of cleated footwear, having sole structures suited for multi-directional traction on natural and/or synthetic turf. Footwear 100, as depicted, may be suited for a variety of activities on natural and/or synthetic turf, such as agility/speed training and competition, as well as other sports, such as baseball, soccer, American football, and other such activities where traction and grip may be significantly enhanced by cleat members. In addition, various features of the disclosed sole structures (and/or variations of such features) may be implemented in a variety of other types of footwear.

Exemplary disclosed ground engaging members may have one or more features that provide increased traction, directional traction, ground penetration, and/or ground extraction. Such features may include, for example, shapes, sizes, positioning on the outer member, as well as the orientation of the ground engaging members.

Ground engaging members may be utilized at any suitable location of an outer member. In some embodiments, ground engaging members having particular shapes and configurations may be disposed at regions of the outer member corresponding with various anatomical portions of the foot. For example, in some cases, one or more ground engaging members may be disposed at a location that corresponds with the first metatarsal head region of the wearer's foot and/or at the region of the foot corresponding with the distal portion of the first phalanx. An athlete may place a significant amount of their weight on these regions of their foot during certain movements, such as cutting in a lateral direction.

In some embodiments, the ground engaging members may have a substantially triangular shape. For example, the ground engaging members may have a substantially triangular cross-sectional shape in a substantially horizontal plane. In some embodiments, a ground engaging member may have a substantially triangular cross-sectional shape over substantially the entire height of the ground engaging member. Accordingly, the ground engaging member may extend from the baseplate to a free end including a substantially planar tip surface that also has a substantially triangular shape. That is, the perimeter of the tip surface may have a substantially triangular shape.

Substantially triangular ground engaging members may provide asymmetrical traction and thus may be oriented to provide more traction in some directions and less traction in others. In addition, at least two of the angles between sides of a triangle must be acute. Such acute angles at the vertices of triangular ground engaging members may provide edges that may be configured to provide increased traction.

It will be noted that, while generally triangular shaped cleats are described in detail herein, other cleat configurations are possible, including, for example, cleats having generally square, rectangular, parallelogram, and/or trapezoidal cross sectional shapes. Such cleats still may have one edge with a vertically concave and/or horizontally concave exterior surface oriented facing away from the peripheral edge of the sole. In some embodiments, a single shoe and/or area of a shoe may have ground engaging members having different overall sizes, shapes, and/or constructions.

The traction provided by triangular ground engaging members may be further increased by forming the sidewalls of the ground engaging members to be concave in one or more respects. For example, the sidewall may be horizontally concave, vertically concave, or both. In addition, the tip surface of a ground engaging member may have edges that are concave. The concavity of ground engaging member sidewalls provides a "scoop" or "shovel" type structure to help provide a solid, non-slipping base for push off. The ground engaging members may be arranged to provide increased traction during select athletic movements by orienting the concave structures in particular directions.

In addition, concavity of ground engaging members may reduce weight, but removing additional material. Further, concavity may increase ground penetration and/or extraction by narrowing the cross-section of the ground engaging member as compared to a non-concave ground engaging member.

In addition to increased traction, ground penetration, and extraction, concavity may form the substantially triangular ground engaging member with a lobe at one or more vertex of the triangle. Lobes may also provide increased traction. Further, because the lobes may be elongate, the traction provided may be substantially directional. That is, a lobe provides the most traction in a direction perpendicular to the direction in which it is elongated. Thus, the orientation of each lobe may be selected to provide traction in a desired direction at a desired region of the ground engaging outer member. Accordingly, additional traction may be provided specifically in a longitudinal (forward-rearward) direction or a lateral (lateral-medial) direction, or at any angle between longitudinal and lateral.

By extending one or more lobes substantially radially (or at other angles) from a ground engaging member, torsional traction may be provided about the ground engaging member. Torsional traction is a characteristic that may be either desirable or undesirable depending on the application. For example, for certain activities, it may be beneficial to have greater freedom of motion. Accordingly, for such activities, a reduced size and/or number of lobes may be utilized at regions of the foot that may serve as pivot points during the activity. For other activities, it may be desirable to provide increased torsional traction in order to increase performance. For example, it may be advantageous to provide a baseball shoe with increased torsional traction at certain portions of the foot, in order to enable a batter to generate more torque by twisting his body during a swing.

In some cases, it may be advantageous to provide increased torsional traction on one foot, and to provide decreased torsional traction on the other foot. For example, while a baseball player may want additional torsional traction at one or more portions of his rear foot (away from the pitcher) to enable him to execute a more powerful swing, he may want a reduced amount of torsional traction at one or more portions on his front foot (closer to the pitcher), to enable greater freedom of motion. Depending on the portion of the foot in question, the opposite may also be true. That is, it may be desirable to provide one or more portions of the rear foot with a reduced amount of torsional traction and provide one or more portions of the front foot with an increased amount of torsional traction. Accordingly, asymmetric outer members may be provided for left and right feet. That is, the left foot outer member may be a non-mirror image of the right foot outer member.

Torsional traction systems may be advantageous for any type of activity where it would be beneficial to generate torque with the body. For example, increased agility may be provided by enabling increased torque to be generated when changing directions. In addition, other exemplary such activities may involve asymmetric motions, such as throwing, swinging, kicking, and other motions. Therefore, exemplary applications where torsional traction systems could be implemented may include, for example, golf, baseball (for hitting as noted above, as well as throwing), American football (throwing by quarterback), javelin, and soccer (kicking).

The foregoing outlines a multitude of parameters regarding the structural configuration of lobes that may be manipulated to provide desired ground penetration, extraction, and traction characteristics at specific locations of the sole of an article of footwear. Accordingly, the shape, size, material, placement, orientation, and other specifications of each individual lobe may be chosen to achieve the desired performance characteristics. This customization of multiple components of a cleat system is reflected in the asymmetric and irregular lobe configurations in the disclosed embodiments. It is noted that the shape, size, orientation, and other parameters of lobes may be inconsistent among ground engaging members in the same sole structure embodiment. Further, it should also be noted that, such variation may also exist among lobes about a common ground engaging member.

As discussed above, the sizing of lobes may have a significant effect on the amount of ground penetration, extraction, and traction provided by the lobe. Accordingly, the sizing of each lobe may be selected according to considerations discussed above in order to achieve desired performance characteristics.

While ground penetration, extraction, and/or traction may be controlled by varying the shape of the lobes, the direction in which the traction may be provided may also be controlled. Each lobe may provide traction in multiple directions. However, due to the elongate structure, the direction of greatest traction provided by lobes may be substantially perpendicular to the direction of elongation.

In some embodiments, one or more lobes may extend substantially radially from an approximate center portion of a ground engaging member. In some embodiments, one or more lobes may extend in a substantially non-radial direction. In some embodiments, all lobes abutting the same ground engaging member may extend radially from the ground engaging member. In some embodiments, all lobes abutting the same ground engaging member may extend in a substantially non-radial direction. Further, in some embodiments, both radially and non-radially oriented lobes may abut the same ground engaging member.

Figure 2:
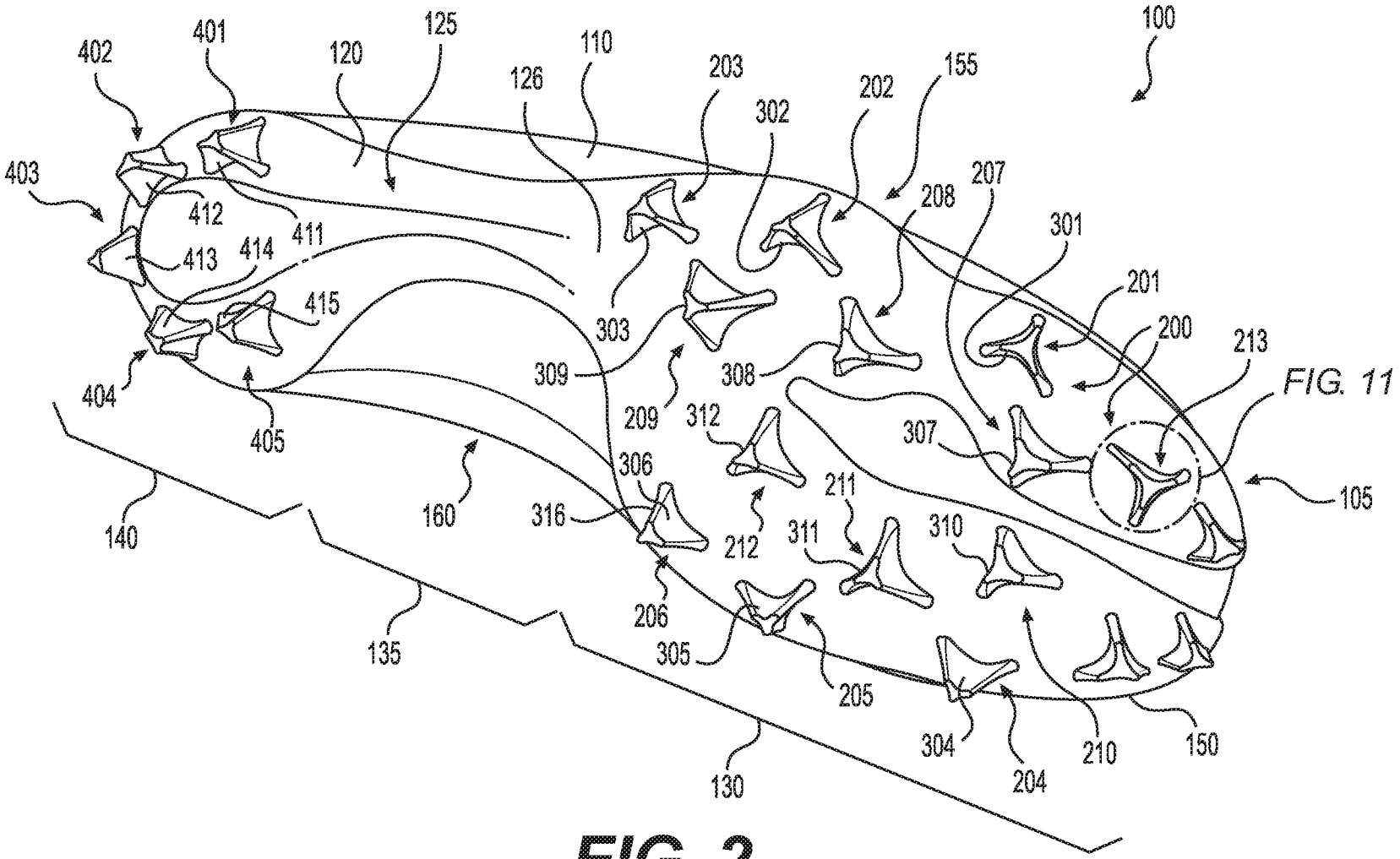
FIG. 2 is a schematic illustration of a lower perspective view of an exemplary ground engaging outer member.

As shown in FIG. 2, footwear 100 ground engaging members 200 may include a plurality of substantially triangular ground engaging members arranged in select orientations according to the location of each ground engaging member. In some embodiments, ground engaging members disposed proximate a peripheral edge of the outer member of the sole structure may be configured with directional traction features that provide traction resisting slipping in a direction facing away from the peripheral edge of the outer member. When the peripheral edge of a footwear outsole contacts the ground first, contacts the ground with more force, or contacts the ground without other portions of the outsole contacting the ground, traction provided at that peripheral edge will often provide the most benefit in terms of performance because not only the vertical loading, but also the horizontal loading is greatest in the peripheral region under these conditions. For example, when the foot strikes the ground on the medial side first and/or with the most force, it is often because the wearer is cutting toward the medial direction or trying to slow down a movement in the lateral direction. In both situations, traction is desired that will resist slippage toward the lateral direction. Accordingly, the footwear may be provided, on the medial side of the outsole, with ground engaging members having concave sides oriented facing away from the medial edge. For similar reasons, the footwear may be provided, on the lateral side, with ground engaging members having concave sides oriented facing away from the lateral edge. Such peripheral ground engaging members may be provided in any region of the foot, including the forefoot region, midfoot region, and heel region. Further, the principles discussed above regarding traction at the periphery of the sole apply to the medial side, lateral side, the front edge of the toe region, and the rear edge of the heel region.

In some embodiments, all, or substantially all, of the peripherally located ground engaging members on an outer member may be configured with concave sides oriented facing away from the peripheral edge. For example, in some embodiments, all, or substantially all, of the ground engaging members disposed proximate to the peripheral edge along the medial side may have concave sidewalls facing away from the peripheral edge, for example, facing in a substantially lateral direction. Similarly, all, or substantially all of the ground engaging members disposed proximate to the peripheral edge along the lateral side may have concave sidewalls facing away from the peripheral edge, for example, facing in a substantially medial direction. In some cases, both the medially disposed ground engaging members and the laterally disposed ground engaging members may be configure as such. Providing all, or substantially all, of the medially disposed ground engaging members and/or all, or substantially all, of the laterally disposed ground engaging members with concave sidewalls facing away from the peripheral edge may maximize the benefits discussed above regarding the characteristics of concave sidewalls and the provision of traction in medial-lateral (i.e., side-to-side) directions. Namely, such configurations may provide increased performance in terms of traction supporting lateral agility.

In some embodiments, footwear 100 may include a plurality of peripheral ground engaging members disposed proximate to a peripheral edge 150 of outer member 120. In some embodiments, such peripheral ground engaging members may be located in forefoot region 130. In some embodiments, such peripheral ground engaging members may include peripheral ground engaging members located in heel region 140. In some embodiments, footwear 100 may include more or less ground engaging members as desired to provide performance characteristics suitable for the desired use.

As shown in FIG. 2, footwear 100 may include a first forefoot peripheral ground engaging member 201 proximate to peripheral edge 150 along a lateral side 155 of outer member 120. Footwear 100 may also include a second forefoot peripheral ground engaging member 202 and a third forefoot peripheral ground engaging member 203 proximate to peripheral edge 150 along lateral side 155. In addition, footwear 100 may also include a fourth forefoot peripheral ground engaging member 204, a fifth forefoot peripheral ground engaging member 205, and a sixth forefoot peripheral ground engaging member 206 disposed proximate peripheral edge 150 along a medial side 160 of outer member 120.

First forefoot peripheral ground engaging member 201 may include a first concave sidewall 301 oriented facing away from peripheral edge 150. Accordingly, since first forefoot peripheral ground engaging member 201 is disposed proximate lateral side 155, first concave sidewall 301 may be oriented facing in a lateral direction. As explained in further detail below, the sidewall may be concave in one or more aspects. For example, the sidewall may be concave in a substantially horizontal plane, in a substantially vertical plane, and an edge of the tip surface may be concave in a horizontal plane.

Second forefoot peripheral ground engaging member 202 may include a second concave sidewall 302 oriented facing away from peripheral edge 150. In addition, third forefoot peripheral ground engaging member 203 may include a third concave sidewall 303 oriented facing away from peripheral edge 150.

In some embodiments, fourth forefoot peripheral ground engaging member 204 may include a fourth concave sidewall 304 oriented facing away from peripheral edge 150. Since fourth forefoot peripheral ground engaging member 204 is disposed proximate medial side 160 of outer member 120, fourth concave sidewall 304 may be oriented facing in a medial direction. In addition, fifth forefoot peripheral ground engaging member 205 may include a fifth concave sidewall 305 oriented facing away from peripheral edge 150, and sixth forefoot peripheral ground engaging member 206 may include a sixth concave sidewall 306 oriented facing away from peripheral edge 150.

In some embodiments, ground engaging members in heel region 140 may also include concave sidewalls oriented facing away from the peripheral edge of the outer member of the baseplate. As shown in FIG. 2, footwear 100 may include a first heel ground engaging member 401, a second heel ground engaging member 402, a third heel ground engaging member 403, a fourth heel ground engaging member 404, and a fifth heel ground engaging member 405. As further shown in FIG. 2, first heel ground engaging member 401 may include a first concave sidewall 411, second heel ground engaging member 402 may include a second concave sidewall 412, third heel ground engaging member 403 may include a third concave sidewall 413, a fourth heel ground engaging member 404 may include a fourth concave sidewall 414, and fifth heel ground engaging member 405 may include a fifth concave sidewall 415. As shown in FIG. 2, first concave sidewall 412, second concave sidewall 412, third concave sidewall 413, fourth concave sidewall 414, and fifth concave sidewall 415 may be oriented facing away from peripheral edge 150 of baseplate 126.

In addition to peripheral ground engaging members, footwear 100 may also include ground engaging members disposed in the central portion of outer member 120, between medial side 150 and lateral side 155 of baseplate 126. Since significant loading is placed in the central portion of outer member 120 during straight-line, forward acceleration and running, such centrally located ground engaging members may be configured with features that provide traction that resists slippage in the rearward direction. For example, in some embodiments, centrally located ground engaging members may include concave sidewalls oriented facing substantially rearward.

For example, as shown in FIG. 2, footwear 100 may include a first central ground engaging member 207, a second forefoot ground engaging member 208, a third forefoot ground engaging member 209, a fourth forefoot ground engaging member 210, a fifth forefoot ground engaging member 211, and a sixth forefoot ground engaging member 212. As further shown in FIG. 2, first central ground engaging member 207 may include a first concave sidewall 307, second forefoot ground engaging member 208 may include a second concave sidewall 308, third forefoot ground engaging member 209 may include a third concave sidewall 309, fourth forefoot ground engaging member 210 may include a fourth concave sidewall 310, fifth forefoot ground engaging member 211 may include a fifth concave sidewall 311, and sixth forefoot ground engaging member 212 may include a sixth concave sidewall 312. As shown in FIG. 2, each of first concave sidewall 307, second concave sidewall 308, third concave sidewall 309, fourth concave sidewall 310, fifth concave sidewall 311, and sixth concave sidewall 312 may be oriented facing in a substantially rearward direction.

It will also be noted that, due to the contours of outer member 120, and the substantially triangular shape of the ground engaging members, in some embodiments, one or more ground engaging members may include both a first concave sidewall oriented facing away from the peripheral edge of the baseplate and a second concave sidewall oriented facing substantially rearward. For example, as shown in FIG. 2, sixth peripheral forefoot ground engaging member 206 may not only include sixth concave sidewall 306 facing away from peripheral edge 150, but also another concave sidewall 316 oriented facing substantially rearward. Because ground engaging member 206 is disposed in a location corresponding with the first metatarsal head, ground engaging member 206 may be subjected to significant loading in many different directions. Most significantly, ground engaging member 206 may be subjected to the highest lateral loading in the medial direction, when cutting in a medial direction. Therefore, sixth concave sidewall 306 may provide traction that resists slipping under such medial loading. Further, because athletes often accelerate on the medial sides of their feet, ground engaging member 206 may be subjected to significant forward loading as the athlete pushes rearward during acceleration. Accordingly, concave sidewall 316 may provide traction that resists this forward loading.

Figure 3:
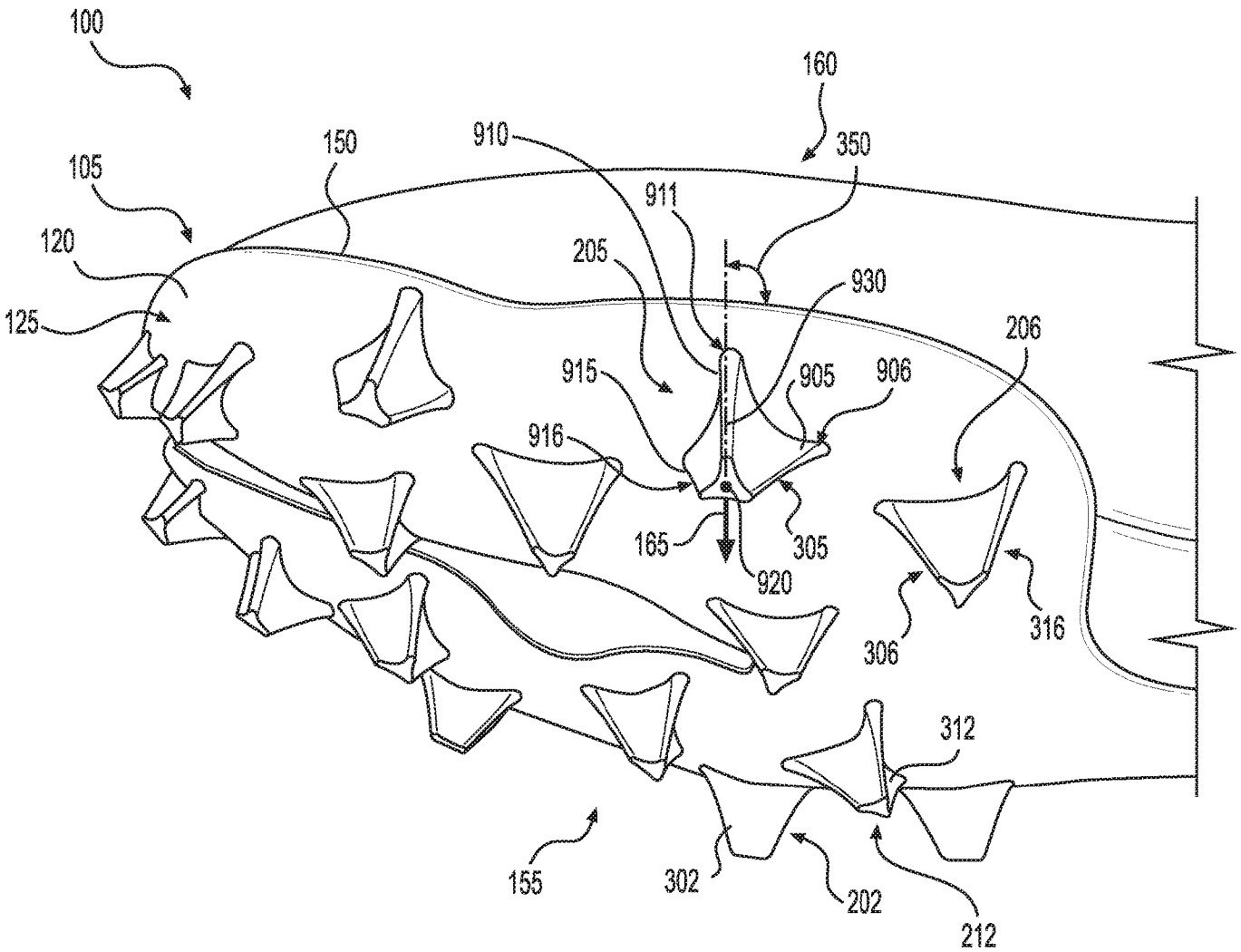
FIG. 3 is a schematic illustration of a lower perspective view of a forefoot region of the outer member shown in FIG. 2.

FIG. 3 is a schematic illustration of a lower perspective view of forefoot region of the outer member shown in FIG. 2. As shown in FIG. 3, fifth peripheral forefoot ground engaging member 205 may be disposed proximate peripheral edge 150 on medial side 160 of outer member 120. In some embodiments, multiple sides of ground engaging member 205 may be concave, thus forming a plurality of lobes between the respective sides. For example, as shown in FIG. 3, ground engaging member 205 may include a first lobe 905, a second lobe 910, and a third lobe 916. Each lobe may extend horizontally to a sidewall edge. For example, first lobe 905 may extend to a first sidewall edge 906, second lobe 910 may extend to a second sidewall edge 911, and third lobe 915 may extend to a third sidewall edge 916. In horizontal cross-section, first sidewall edge 906, second sidewall edge 911, and third sidewall edge 916 may form vertices of the substantially triangular shape of ground engaging member 205 in a horizontal plane.

In some embodiments, lobes of the ground engaging members may extend substantially radially from a central portion of the ground engaging member. Further, in some embodiments, sidewall edges may be disposed opposite concave sidewall portions. For example, as shown in FIG. 3, second lobe 910 of ground engaging member 205 may extend along an axis 930. In some embodiments, axis 930 may extend substantially radially from a central portion (e.g., center point 920) of ground engaging member 205. As further shown in FIG. 3, in some embodiments, axis 930 of second lobe 910 may be oriented substantially perpendicular to peripheral edge 150. Further, in some embodiments, concave surface 305 may be oriented facing away from peripheral edge 150, for example in a direction indicated by arrow 165, which points in a direction opposite lobe 910, and thus, also substantially perpendicular to peripheral edge 150.

In some embodiments, a ground engaging member may include a first sidewall, second sidewall, and third sidewall arranged to form three sides of the substantially triangular cross-sectional shape in a substantially horizontal plane. In some cases, the first sidewall, second sidewall, and third sidewall may all be concave in the substantially horizontal plane.

Figure 4:
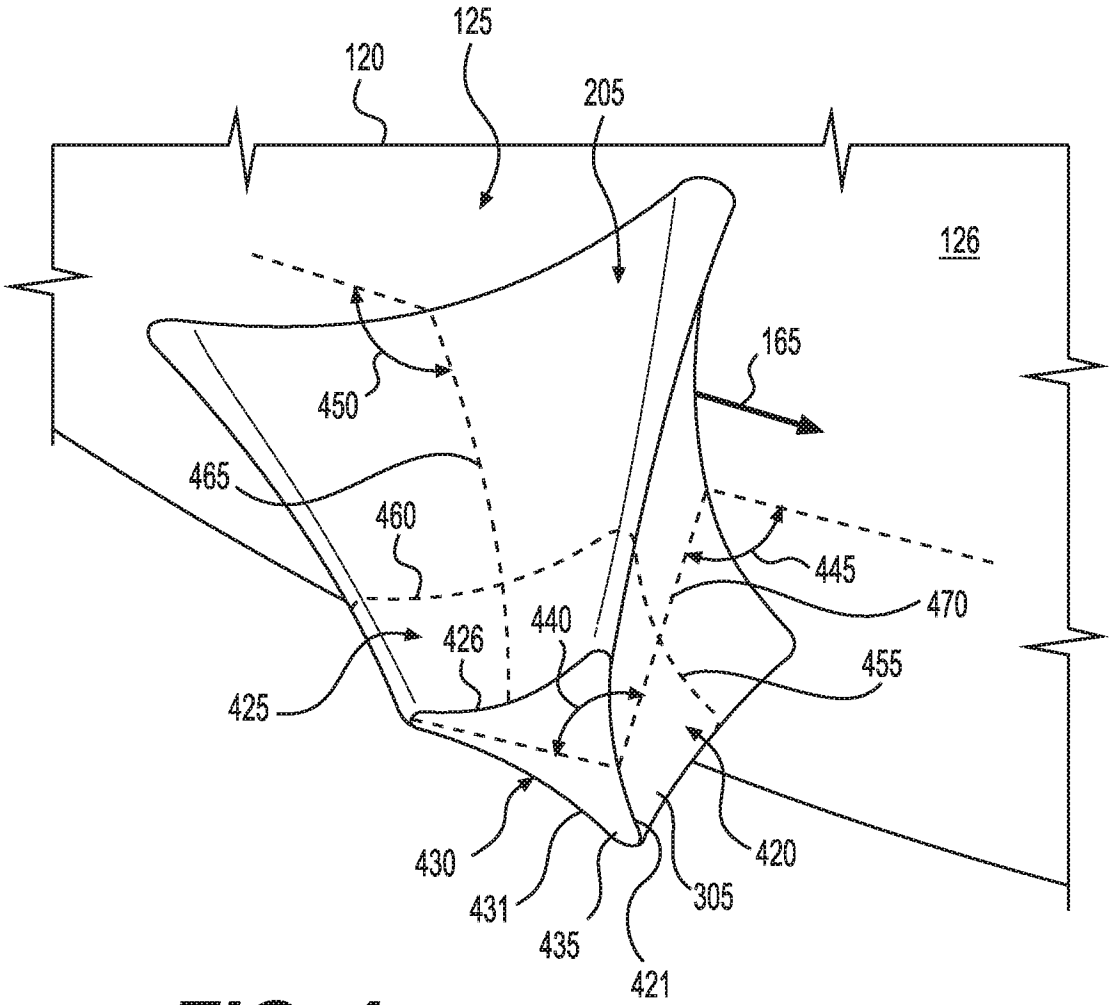
FIG. 4 is a schematic illustration of an enlarged view of an exemplary ground engaging member.

FIG. 4 is a schematic illustration of an enlarged view of ground engaging member 205. In the view shown in FIG. 4, concave sidewall 305 is shown on the right, facing in a substantially lateral direction indicated by arrow 165. As shown in FIG. 4, the sidewalls of ground engaging member 205 may be concave in one or more aspects. For example, a dashed line 455 indicates the concavity of first sidewall surface 420 of sidewall 305 in a substantially horizontal plane. In addition, dashed line 460 indicates the concavity of a second sidewall surface 425 in the same substantially horizontal plane.

In some embodiments, a ground engaging member may include sidewall surfaces that are concave in a substantially vertical plane. This vertical concavity may provide the ground engaging member with a tapered cross-section. This tapered cross-section may facilitate ground penetration and egress. Further, a tapered cross-section may limit the collection of soil, grass, and other debris on the outer member of the sole.

As shown in FIG. 4, a dashed line 465 indicates the concavity of second sidewall surface 425 in a substantially vertical plane. As illustrated in FIG. 4, this vertical concavity may provide ground engaging member 205 with a tapered profile, as indicated by an obtuse angle 450 where second sidewall surface 425 intersects with baseplate 126. In contrast, for example, first sidewall surface 420 may intersect with baseplate 126 at a substantially perpendicular angle 445.

In some embodiments, the vertical concavity of the sidewalls may be the same for each sidewall of the ground engaging member. In other embodiments, the vertical concavity may be different for different sidewall surfaces. For example, as shown in FIG. 4, a dashed line 470 is substantially linear, indicating a substantially straight surface in a substantially vertical direction. That is, while first sidewall surface 420 may have a substantially concave cross-sectional shape in a substantially horizontal plane, first sidewall surface may have a substantially straight cross-sectional shape in a substantially vertical plane. As further shown in FIG. 4, this configuration may differ from second sidewall surface 425. Further, a third sidewall 430 may have either configuration.

In addition to the configuration of the sidewalls, the tip surface of ground engaging members may also have concave edges. The edges of a substantially planar tip surface may provide traction similar to an ice skate. By providing such edges with a concavity in a substantially horizontal plane, this traction may be further increased.

As shown in FIG. 4, ground engaging member 205 may include a substantially planar tip surface 435. Tip surface may be substantially planar in a substantially horizontal plane. Accordingly, in some embodiments, first sidewall surface 420 (which may be substantially vertical) may be substantially perpendicular to tip surface 435. Tip surface 435 may have a substantially triangular shape, having a first tip surface edge 421, a second tip surface edge 426, and a third tip surface edge 431. As shown in FIG. 4, in some embodiments, at least one of first tip surface edge 421, second tip surface edge 426, and third tip surface edge 431 may be concave in the substantially horizontal plane in which tip surface 435 resides.

Figure 5:
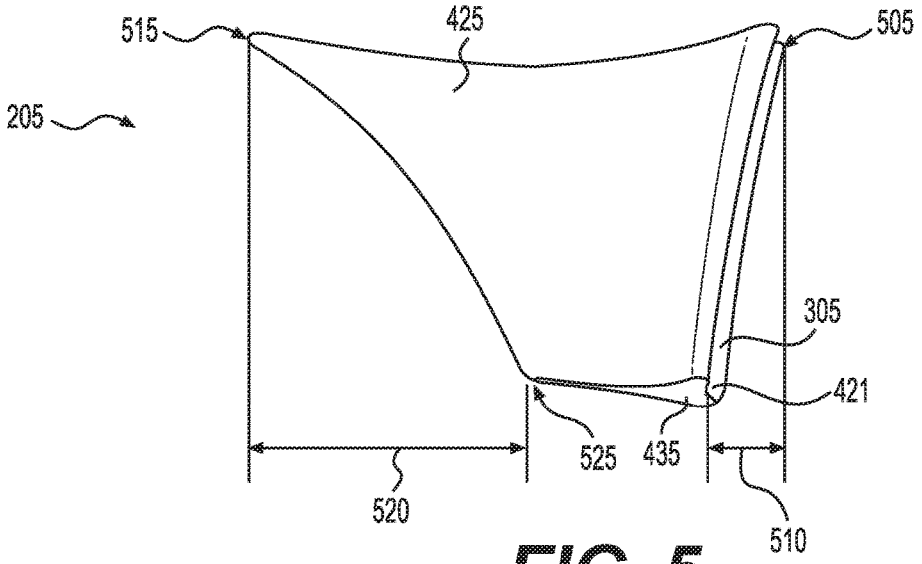
FIG. 5 is a schematic illustration of a side view of an exemplary ground engaging member.

FIG. 5 is a side view of ground engaging member 205. In some embodiments, adjacent lobes may extend in substantially opposite directions, thus providing the ground engaging member with an irregular profile. For example, as shown in FIG. 5, a first tip 505 of ground engaging member 205 adjacent to the baseplate on the side of sidewall 305 may extend a first distance 510 from first tip surface edge 421. A second tip 515 may extend a second distance 520 from a tip surface vertex 525 disposed opposite first tip surface edge 421. As shown in FIG. 5, second distance 520 may be significantly greater than first distance 510. Since sidewall 305 is oriented to provide traction in the direction resisting the greatest loading to which ground engaging member 205 is subjected, the extended second tip 515 may provide additional strength under such loading. Thus, the lobes of the ground engaging member adjacent to sidewall surface 305 may flare outward to provide a broader surface for engaging the ground in the direction in which traction is most desired at the location of ground engaging member 205. (See also FIG. 9 for further illustration of the irregular sizing and positioning of ground engaging member lobes.)

Figure 6:
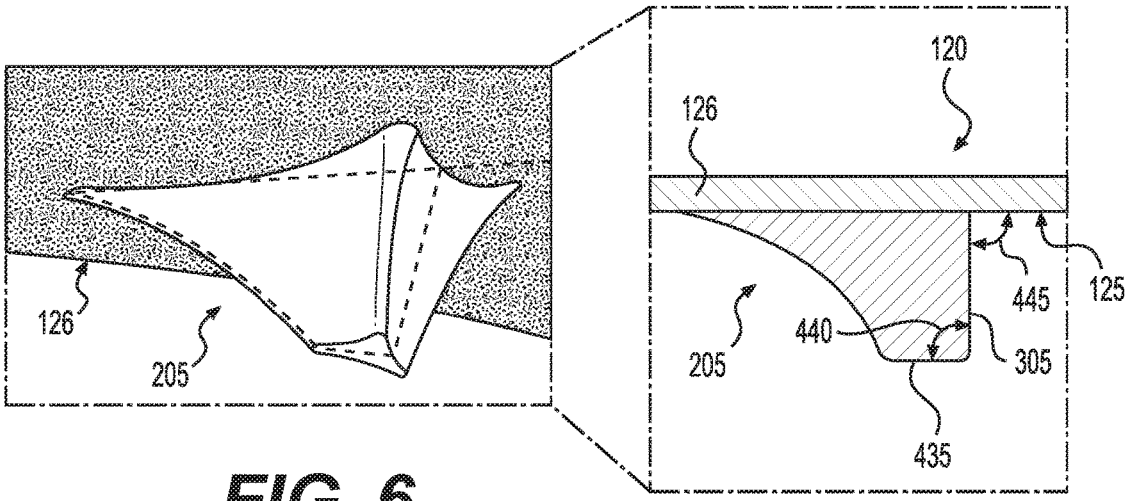
FIG. 6 is a schematic illustration of a perspective view and a cross-sectional view of the ground engaging member shown in FIG. 5.

FIG. 6 shows perspective and cross-sectional views of ground engaging member 205. As shown in FIG. 6, sidewall surface 305 may form a substantially perpendicular angle 445 with lower surface 125 of baseplate 126 of outer member 120. FIG. 6 further illustrates the substantially perpendicular angle 440 between sidewall surface 305 and tip surface 435.

In some embodiments, the sidewall surface of the ground engaging member may concave in yet another aspect. In some embodiments, a sidewall surface of a ground engaging member may form an acute angle with the baseplate. Such a configuration may provide increased grip in the direction in which the acutely angled surface is facing.

Figure 7:
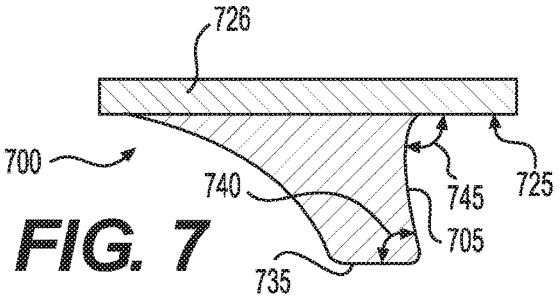
FIG. 7 is a schematic illustration of a cross-sectional view, illustrating an alternative configuration for a ground engaging member.

FIG. 7 illustrates an alternative configuration for a ground engaging member, shown in a cross-sectional view similar to FIG. 6. As shown in FIG. 7, a ground engaging member 700 may extend from a lower surface 725 of a baseplate 726. Ground engaging member 700 may include a sidewall surface 705 and a tip surface 735. As shown in FIG. 7, in a substantially vertical plane, sidewall surface 705 may form an acute angle 745 with lower surface 725 of baseplate 726. In some embodiments, tip surface 735 may be disposed in a substantially horizontal plane, that is, substantially parallel to lower surface 725 of baseplate 726. Accordingly, sidewall surface 705 may form an acute angle 740 with tip surface 735.

In some embodiments, the sidewall surface of a ground engaging member may form a non-acute angle with the lower surface of the baseplate. For example, in some embodiments, the sidewall surface may form a substantially perpendicular angle with the baseplate. In other embodiments, the sidewall surface may form an obtuse angle with the lower surface of the baseplate. Non-acute angles, such as substantially perpendicular angles or obtuse angles may provide the ground engaging member with increased ground penetration and may facilitate extraction of the ground engaging member from the ground.

Figure 8:
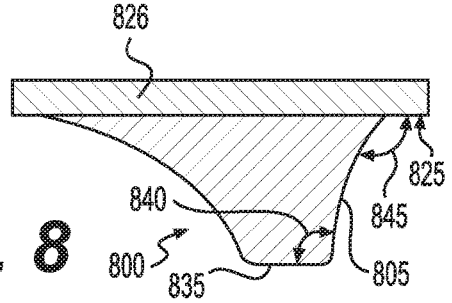
FIG. 8 is a schematic illustration of a cross-sectional view, illustrating another alternative configuration for a ground engaging member.

FIG. 8 illustrates an alternative configuration for a ground engaging member, shown in a cross-sectional view similar to FIG. 6. As shown in FIG. 8, a ground engaging member 800 may extend from a lower surface 825 of a baseplate 826. Ground engaging member 800 may include a sidewall surface 805 and a tip surface 835. As shown in FIG. 8, in a substantially vertical plane, sidewall surface 805 may form an obtuse angle 845 with lower surface 825 of baseplate 826. In some embodiments, tip surface 835 may be disposed in a substantially horizontal plane, that is, substantially parallel to lower surface 825 of baseplate 826. Accordingly, sidewall surface 805 may form an acute angle 840 with tip surface 835.

In some embodiments, the lobes of the ground engaging member may extend in a substantially radial direction from the vertices of the substantially triangular tip surface. Such a configuration may provide predicable traction and may be manufactured relatively quickly.

Figure 9:
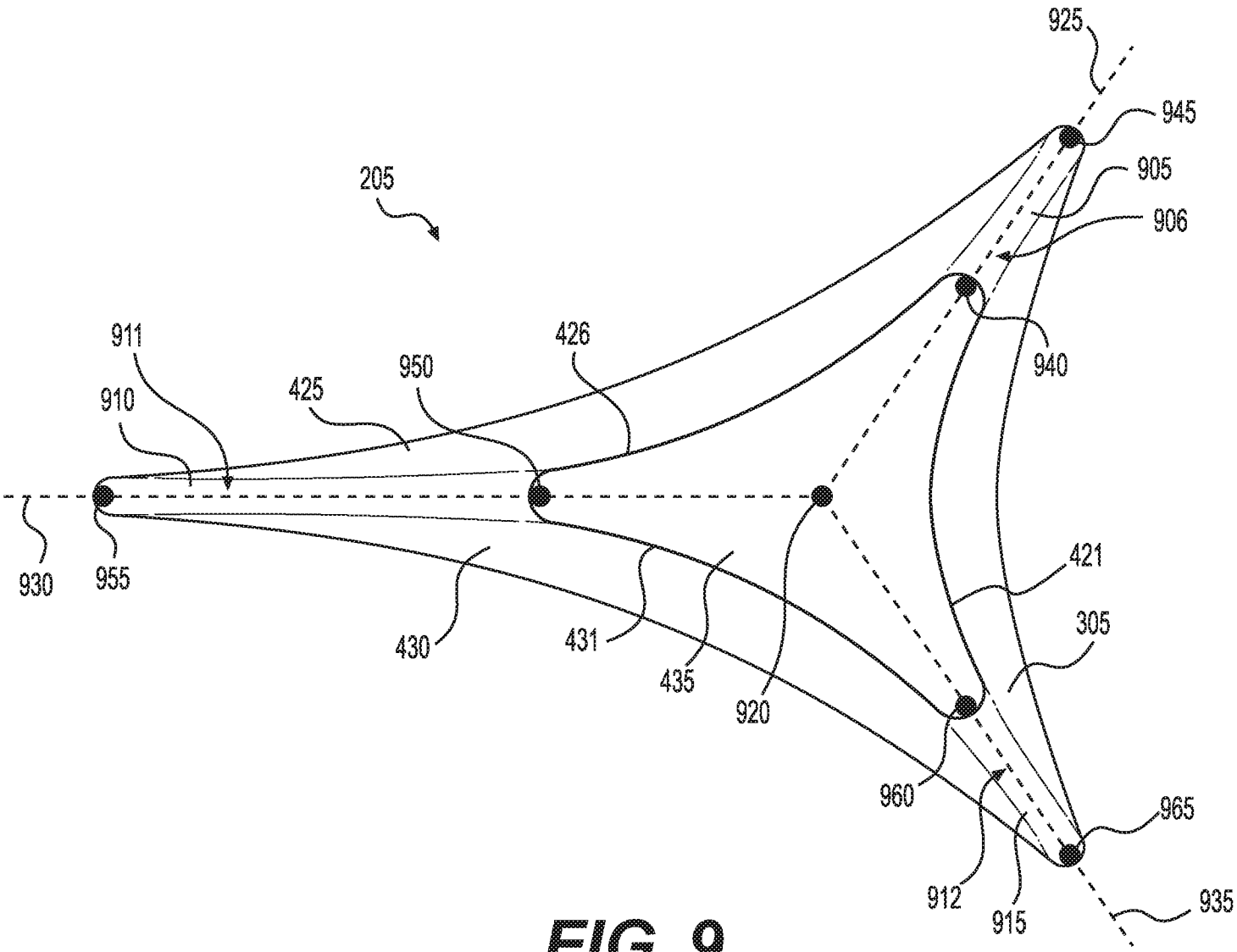
FIG. 9 is a schematic illustration of a bottom view of an exemplary ground engaging member.

FIG. 9 is a bottom view of ground engaging member 205. As shown in FIG. 9, tip surface 435 of ground engaging member 205 may have an approximate center point 920. Tip surface 435 may have a first tip vertex 940 disposed on a first radial axis 925, a second tip vertex 950 disposed on a second radial axis 930, and a third tip vertex 965 disposed on a third radial axis 935. As further shown in FIG. 9, ground engaging member 205 may include a first lobe 905 extending to a first sidewall edge 906. In addition, ground engaging member 205 may include a second lobe 910 extending to a second sidewall edge 911. Also, ground engaging member 205 may include a third lobe 915 extending to a third sidewall edge 916. First sidewall edge 906 may intersect with the baseplate at a first base vertex 945. Similarly, second sidewall edge 911 may intersect with the baseplate at a second base vertex 955. Further, third sidewall edge 916 may intersect with the baseplate at a third base vertex 965. As shown in FIG. 9, first base vertex 945 may be disposed along the same first axis 925 as first tip vertex 940. Similarly, second base vertex 955 may be disposed along the same second axis 930 as second tip vertex 950. Further, third base vertex 965 may be disposed along the same third axis 935 as third tip vertex 960.

Figure 10:
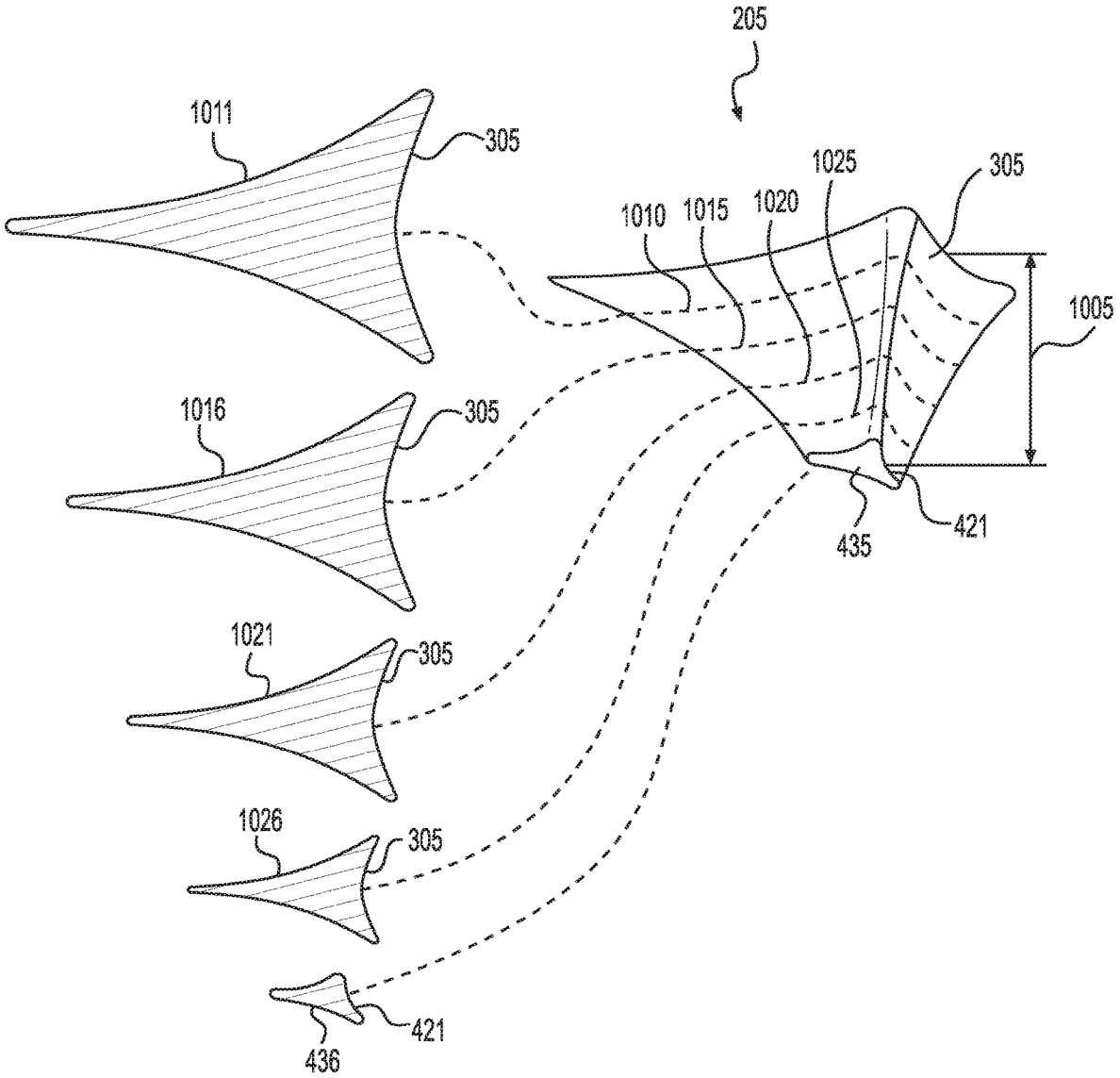
FIG. 10 is a schematic illustration of a perspective view and multiple cross-sectional views of the ground engaging member shown in FIG. 9.

FIG. 10 shows a perspective view and multiple cross-sectional views of ground engaging member 205, further illustrating the substantially radial extension of the lobes. FIG. 10 illustrates the horizontal cross-sectional shape of ground engaging member 205 taken at several substantially horizontal planes along the height 1005 of ground engaging member 205 between tip surface 435 and the baseplate. At a first section line 1010, ground engaging member 205 has a first cross-sectional shape 1011. At a second section line 1015, ground engaging member 205 has a second cross-sectional shape 1016. At a third section line 1020, ground engaging member 205 has a third cross-sectional shape 1021. At a fourth section line 1025, ground engaging member 105 has a fourth cross-sectional shape 1026. Further, at tip surface 435, ground engaging member has a fifth cross-sectional shape 436.

As illustrated in FIG. 10, first cross-sectional shape 1011, second cross-sectional shape 1016, third cross-sectional shape 1021, fourth cross-sectional shape 1026, and fifth cross-sectional shape 436 may all have substantially the same shape in differing sizes. As further illustrated, the sidewalls may be concave in a horizontal direction over a substantial majority of height 1005 of ground engaging member 205. In some embodiments, the sidewalls may be concave in a horizontal direction over at least 90% of the height dimension of a ground engaging member.

Further, it will be noted that each shape is oriented in substantially the same orientation, as the lobes extend substantially radially (as shown and discussed regarding FIG. 9).

In some embodiments, one or more lobes of a ground engaging member may extend in non-radial direction. Non-radial lobes may provide a twisted configuration similar to turbine blades. Such a configuration may provide increased traction in the direction in which the lobes extend, and less traction in the opposing direction. Further, such a configuration will provide rotational traction about the approximate center point of the ground engaging member that is stronger in one direction than the other. For example, such a ground engaging member may provide increased traction in a clockwise direction but not in a counter-clockwise direction.

Figure 11:
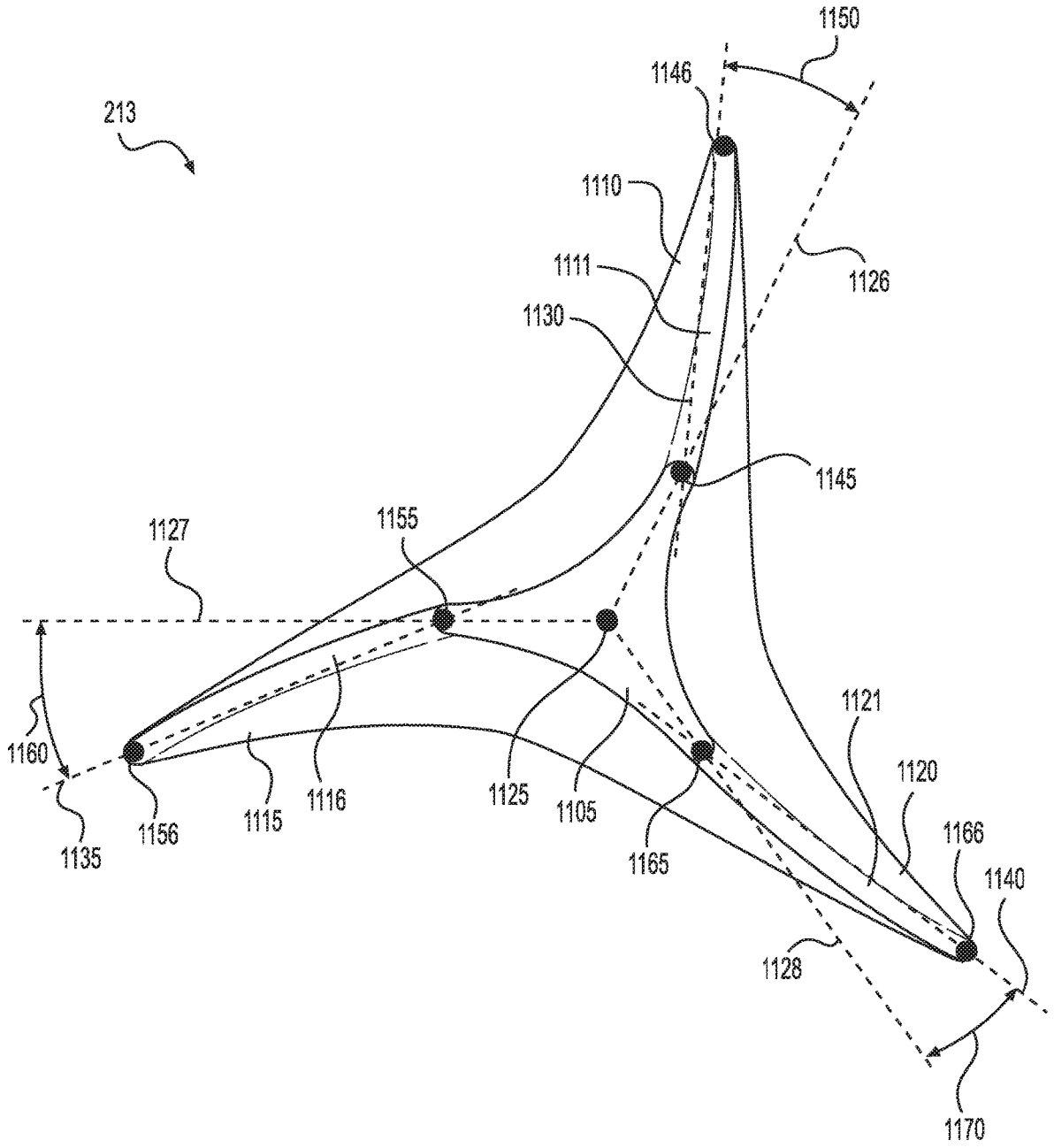
FIG. 11 is a schematic illustration of a bottom view of another exemplary ground engaging member.

FIG. 11 is a bottom view of a ground engaging member 213 (see FIG. 2). As shown in FIG. 2, ground engaging member 213 may be located toward a forward end of the sole in a toe region. Ground engaging member 213 may be configured with non-radial lobes that provide increased traction during medial heel rotation, but allow lateral heel rotation more freely. Such directional traction may reduce undesired stress on leg anatomy, such as the knees and ankles, during twisting motions.

As shown in FIG. 11, ground engaging member 213 may include a tip surface 1105. Ground engaging member 213 may further include a first lobe 1110 extending to a first sidewall edge 1111, a second lobe 1115 extending to a second sidewall edge 1116, and a third lobe 1120 extending to a third sidewall edge 1121. Tip surface 1105 may have a substantially triangular shape including a first tip vertex 1145, a second tip vertex 1155, and a third tip vertex 1165. First tip vertex 1145 may be disposed on a first radial axis 1126 extending from an approximate center point 1125 of ground engaging member 213. In addition, second tip vertex 1155 may be disposed on a second radial axis 1127 extending from center point 1125 and third tip vertex 1165 may be disposed on a third radial axis 1128 extending from center point 1125.

First sidewall edge 1111 of first lobe 1110 may extend to a first base vertex 1146. Second sidewall edge 1116 of second lobe 1115 may extend to a second base vertex 1156. And third sidewall edge 1121 of third lobe 1120 may extend to a third base vertex 1166. First base vertex 1146 may be disposed on a first non-radial axis 1130. Second base vertex 1156 may be disposed on a second non-radial axis 1135. And third base vertex 1166 may be disposed on a third non-radial axis 1140. Accordingly, first lobe 1110, second lobe 1115, and third lobe 1120 may each extend on a non-radial axis. First non-radial axis 1130 may be located at a first angle 1150 with respect to first radial axis 1126. Similarly, second non-radial axis 1135 may be located at a second angle 1160 with respect to second radial axis 1127. And third non-radial axis 1140 may be located at a third angle 1170 with respect to third radial axis 1128. In some embodiments, first angle 1150, second angle 1160, and third angle 1170 may be substantially the same. In other embodiments, one or more of these angles may be different than the others in order to provide directional traction.

Figure 12:
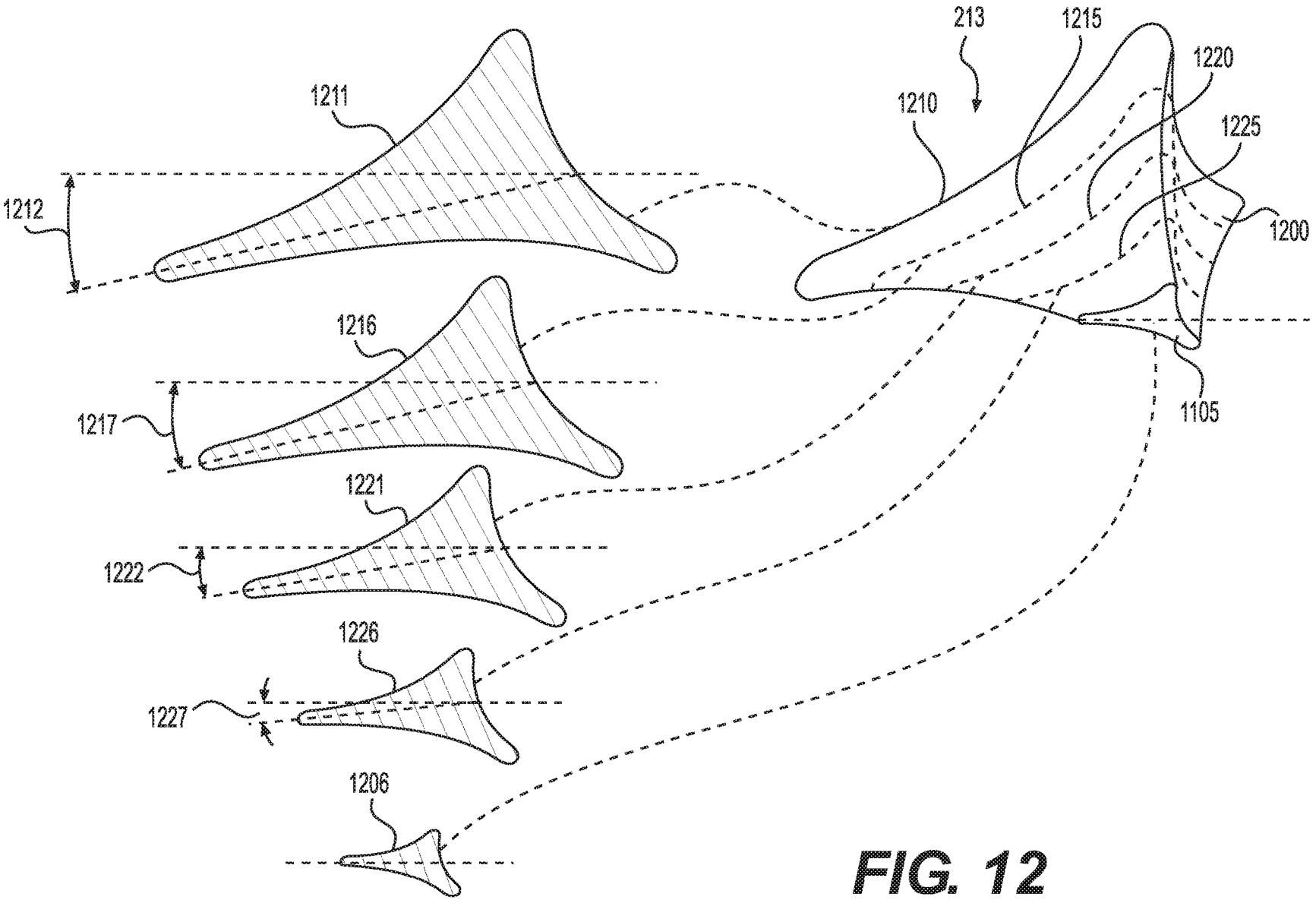
FIG. 12 is a schematic illustration of a perspective view and multiple cross-sectional views of the ground engaging member shown in FIG. 11.

FIG. 12 shows a perspective view and multiple cross-sectional views of ground engaging member 213 shown in FIG. 11. As shown in FIG. 12, a base perimeter 1210 of ground engaging member 213 may have a base cross-sectional shape 1211. In addition, at a first section line 1215, ground engaging member 213 may have a first cross-sectional shape 1216. Further, at a second section line 1220, ground engaging member 213 may have a second cross-sectional shape 1221. Also, at a third section line 1225, ground engaging member 213 may have a third cross-sectional shape 1226. And, tip surface 1105 may have a tip cross-sectional shape 1206. As shown in FIG. 12, the cross-sectional shapes are substantially similar shape, but differ in size reflecting the tapered configuration of ground engaging member 213. In addition, the cross-sectional shapes differ in orientation. For example, base cross-sectional shape 1211 is rotated at a base angle of 1112 with respect to tip cross-sectional shape 1206. Similarly, first cross-sectional shape 1216 is rotated at first angle 1217, second cross-sectional shape 1221 is rotated at a second angle 1222, and third cross-sectional shape 1226 is rotated at a second angle 1227 with respect to tip cross-sectional shape 1206. As shown in FIG. 12, base angle 1212, first angle 1217, second angle 1222, and third angle 1227 differ, reflecting the increasing deviation of the lobes in non-radial directions along the height of ground engaging member 213. The differences between these angles may be consistent. In other embodiments, they may vary from the top to the bottom of the ground engaging member. Further, in some embodiments, the angles may be consistent for one lobe, but may differ for other lobes on the same ground-engaging member.

Figure 13:
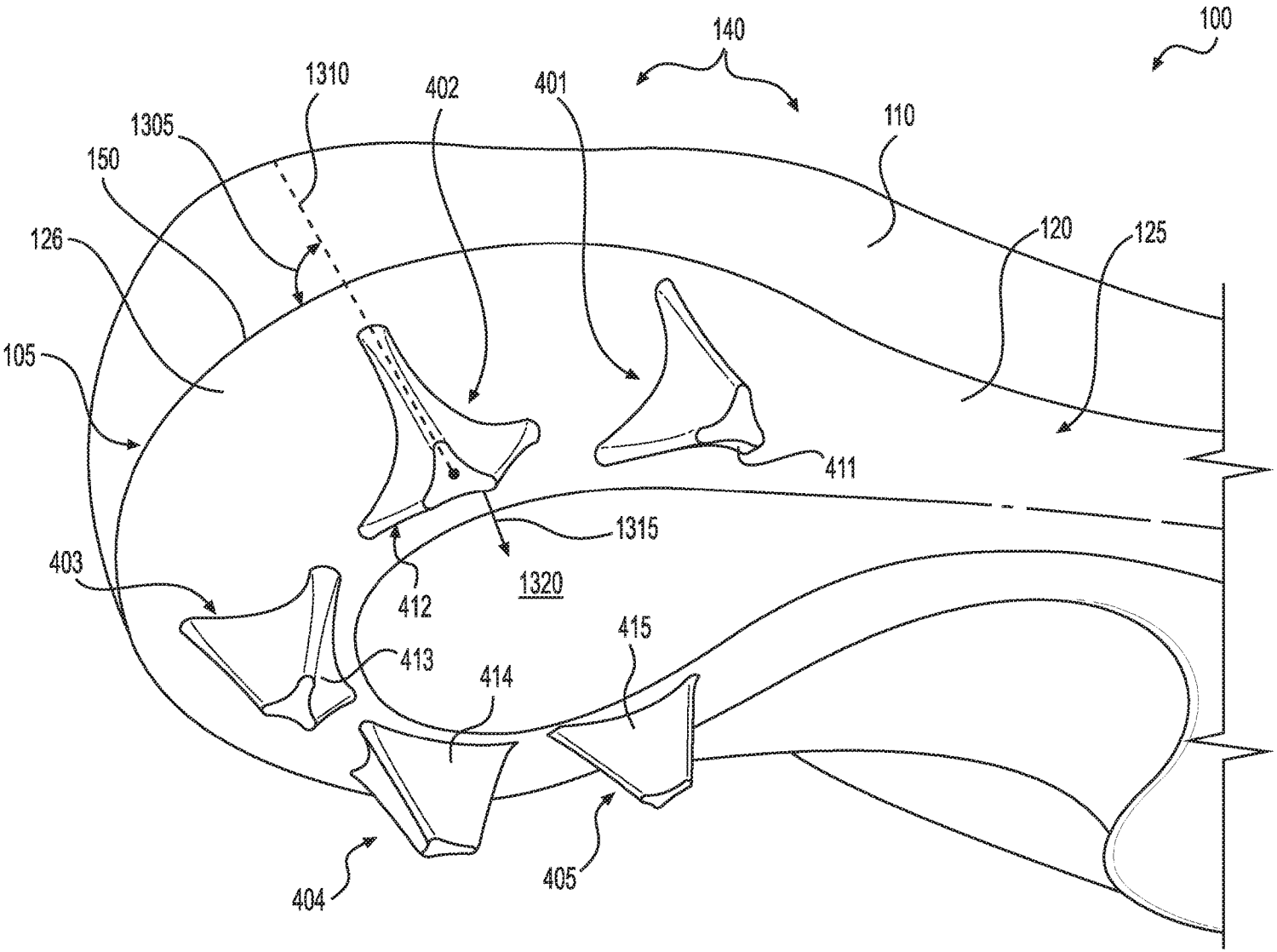
FIG. 13 is a schematic illustration of a bottom perspective view of an arrangement of ground engaging members in a heel region of an article of footwear.

FIG. 13 is a bottom perspective view of an arrangement of ground engaging members in heel region 140 of article of footwear 100. As shown in FIG. 13, first concave sidewall 411, second concave sidewall 412, third concave sidewall 413, fourth concave sidewall 414, and fifth concave sidewall 415 may be oriented facing away from peripheral edge 150 toward a central portion 1320 of heel region 140. As further shown in FIG. 13, a lobe of second heel ground engaging member 402 may extend along an axis 1310, which may be disposed at an angle 1305 with respect to peripheral edge 150. In some embodiments, angle 1305 may be a substantially perpendicular angle. In addition, second concave sidewall 412 of second heel ground engaging member 402 may be oriented facing away from peripheral edge 150 in a direction indicated by arrow 1315, toward central portion 1320. As discussed above, this configuration of ground engaging members may provide directional traction regardless of which side of the wearer's heel contacts the ground first and/or with more force.

Figure 14:
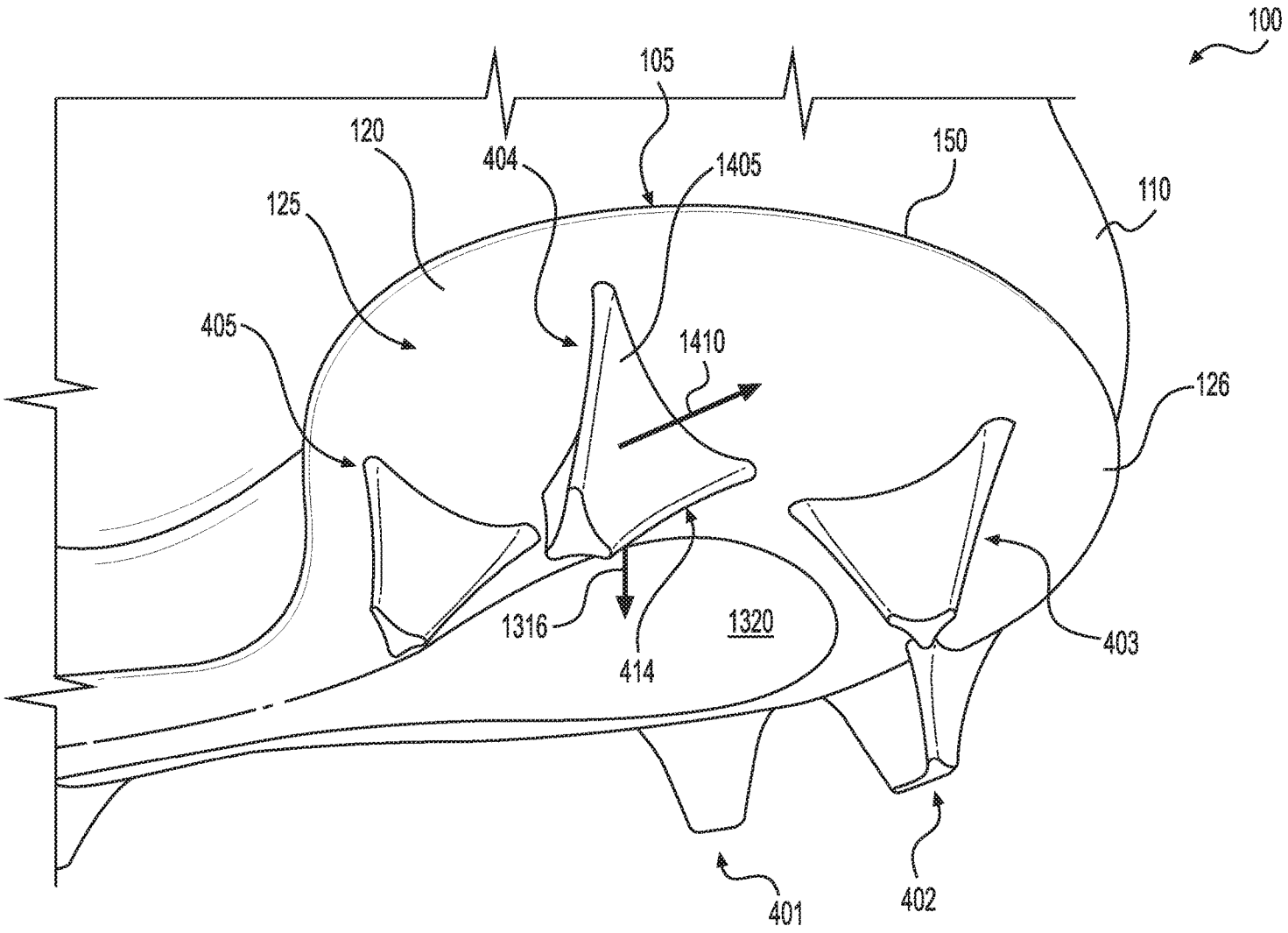
FIG. 14 is a schematic illustration of another bottom perspective view of the arrangement of ground engaging members shown in FIG. 13.

FIG. 14 is another bottom perspective view of the arrangement of ground engaging members shown in FIG. 13. As shown in FIG. 14, due to the curvature of peripheral edge 150, and the substantially triangular shape of the ground engaging members, in some cases, a ground engaging member may have a concave sidewall that is oriented facing away from peripheral edge 150, and a second concave sidewall that is oriented facing substantially rearward. For example, as shown in FIG. 14, fourth heel ground engaging member 404 may have a fourth concave sidewall 414 that is oriented facing away from peripheral edge 150, toward central portion 1320 in a direction indicated by arrow 1316. In addition, second heel ground engaging member 404 may also include a second sidewall 1405, which may be oriented facing substantially rearward, in a direction indicated by arrow 1410. As discussed above, the medial side of footwear may be loaded significantly during acceleration. Accordingly, a medially disposed ground engaging member such as second heel ground engaging member 404 may provide not only increased lateral traction, but also increased traction for straight-line acceleration.

Figure 15:
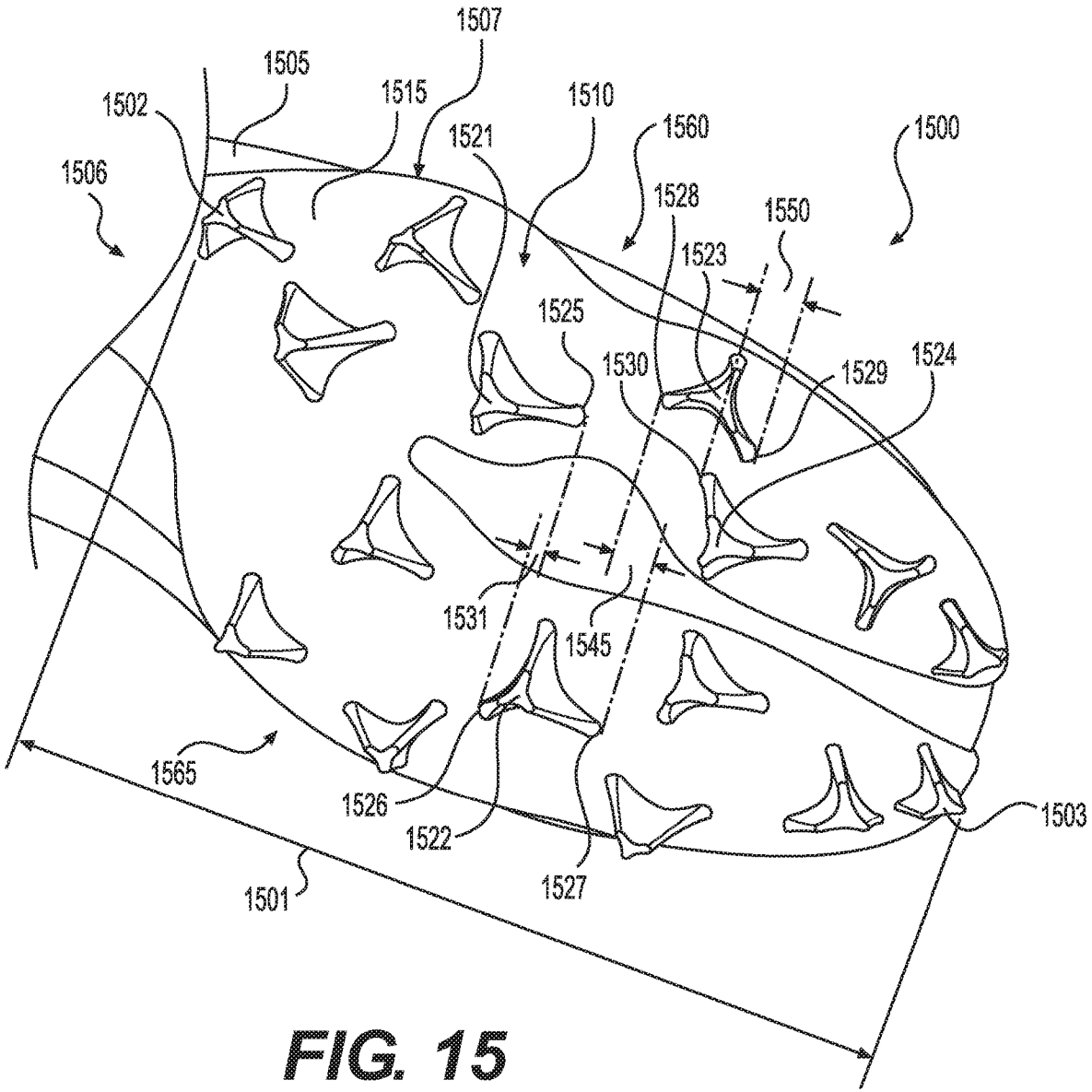
FIG. 15 is a schematic illustration of a bottom view of a forefoot region of an article of footwear showing longitudinal overlapping of ground engaging members.

FIG. 15 is a bottom view of a forefoot region of an article of footwear 1500 showing longitudinal overlapping of ground engaging members. Footwear 1500 and the ground engaging members shown in FIG. 15 may have any of the features described above regarding other embodiments, including the embodiment shown in FIG. 2, which is shown having the same configuration of ground engaging members. As shown in FIG. 15, the forefoot region of footwear 1500 may have a longitudinal length 1501 extending from a rearmost forefoot ground engaging member 1502 and a forward-most forefoot ground engaging member 1503. In addition, footwear 1500 has a lateral side 1560 and a medial side 1565.

Footwear 1500 may include an upper 1505 and a sole structure 1506 fixedly attached to a bottom portion of upper 1505. Sole structure 1506 may include a ground engaging outer member 1507, which may include a baseplate 1510 having a ground engaging bottom surface 1515. Further, outer member 1507 may include a plurality of ground engaging members extending substantially downward from bottom surface 1515 of baseplate 1510.

In some embodiments, two or more of the ground engaging members may be longitudinally overlapping. In some embodiments, the ground engaging members of the forefoot region may be disposed overlapping one another in a longitudinal direction such that all portions of the longitudinal length of the forefoot region are occupied by at least one ground engaging member. For purposes of discussion, several overlapping ground engaging members will be discussed, but it will be understood that ground engaging members may be longitudinally overlapping along the entire longitudinal length of forefoot region. By disposing ground engaging members longitudinally along the entire longitudinal length of the forefoot region, traction may be provided in the lateral direction along the entire longitudinal length of the forefoot region.

Some laterally extending portions of the forefoot region (e.g., corresponding with the metatarso-phalangeal joints) may have a reduced number of ground engaging members, in order to provide the outer member with flexibility. Such portions may include at least one ground engaging member, however, in order to provide traction in the lateral direction.

As shown in FIG. 15, outer member 1507 may include at least a first ground engaging member 1521, a second ground engaging member 1522, a third ground engaging member 1523, and a fourth ground engaging member 1524. In some embodiments, a substantial majority of first ground engaging member 1521 may be disposed further rearward than a substantial majority of second ground engaging member 1522, and portions of first ground engaging member 1521 and second ground engaging member 1522 may overlap longitudinally along longitudinal length 1501 of the forefoot region. As shown in FIG. 15, first ground engaging member 1521 may include a first forward-most portion 1525. Second ground engaging member 1522 may include a second rearward-most portion 1526. As shown in FIG. 15, first ground engaging member 1521 may longitudinally overlap with second ground engaging member 1522. For example, first forward-most portion 1525 of first ground engaging member 1521 may extend further forward than second rearward-most portion 1526 of second ground engaging member 1522. Thus, first ground engaging member 1521 may longitudinally overlap with second ground engaging member 1522 in a first overlapping region 1531.

In addition, second ground engaging member 1522 and third ground engaging member 1523 may longitudinally overlap one another. As shown in FIG. 15, second ground engaging member 1522 may include a third forward-most portion 1527, and third ground engaging member 1523 may include a fourth rearward-most portion 1528. In some embodiments, third forward-most portion 1527 of second ground engaging member 1522 may extend further forward than fourth rearward-most portion 1528 of third ground engaging member 1523. Thus, second ground engaging member 1522 may longitudinally overlap with third ground engaging member 1523 in a second overlapping region 1545.

Similarly, third ground engaging member 1523 may longitudinally overlap with fourth ground engaging member 1524. As shown in FIG. 15, third ground engaging member 1523 may include a fifth forward-most portion 1529 and fourth ground engaging member 1524 may include a sixth rearward-most portion 1530. In some embodiments, fifth forward-most portion 1529 of third ground engaging member 1523 may extend further forward than sixth rearward-most portion 1530 of fourth ground engaging member 1524. Thus, third ground engaging member 1523 may longitudinally overlap with fourth ground engaging member 1524 in a third overlapping region 1550.

It will be noted that second ground engaging member 1522 may be the sole ground engaging member disposed in the laterally-extending region that corresponds with the metatarso-phalangeal joints of the foot of a wearer. This may provide flexibility to facilitate foot flexion, while maintaining traction in the lateral direction.

Figure 16:
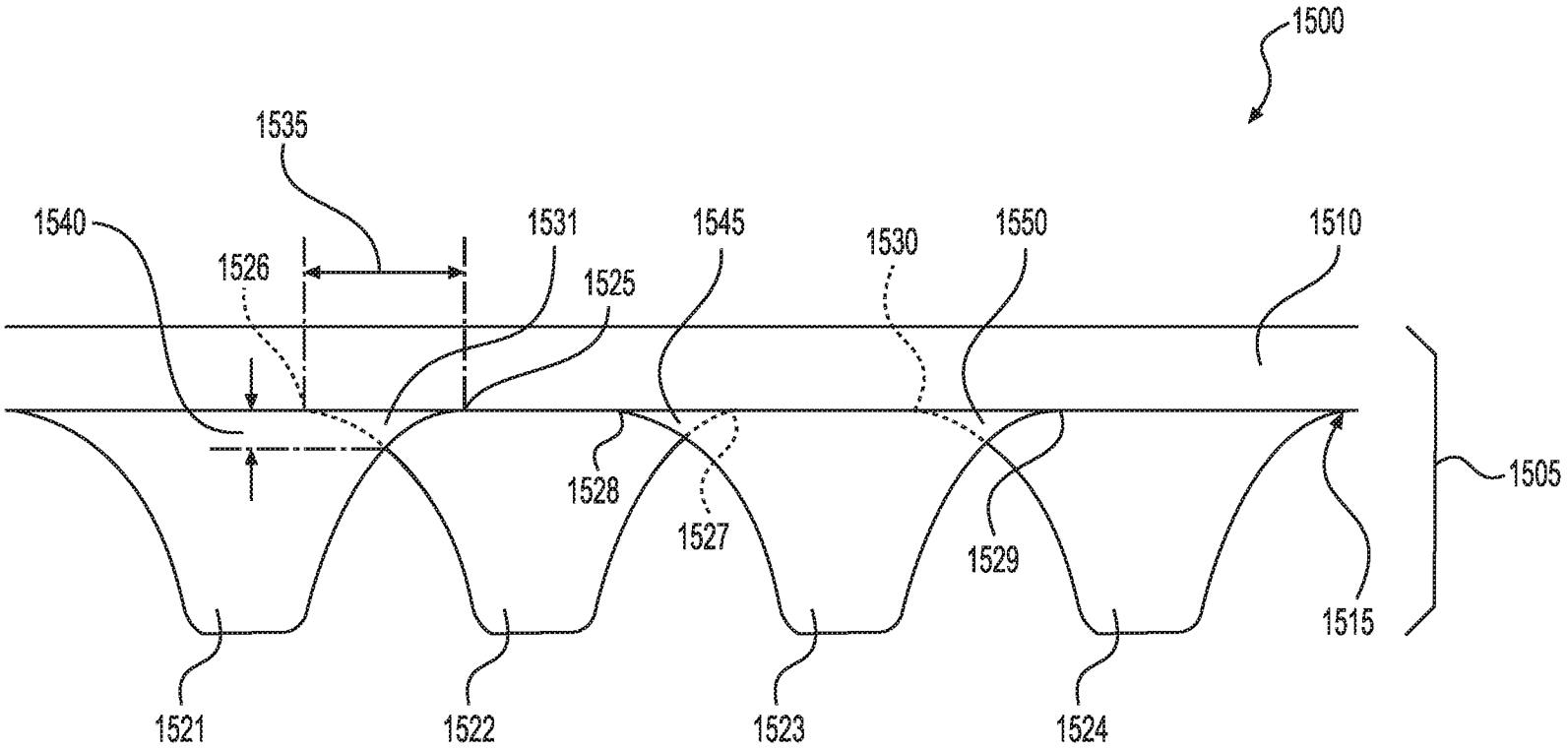
FIG. 16 is a schematic illustration of a partial lateral side view of the article of footwear shown in FIG. 15.

FIG. 16 is a partial lateral side view of the article of footwear shown in FIG. 15. As shown in FIG. 16, first ground engaging member 1521, second ground engaging member 1522, third ground engaging member 1523, and fourth ground engaging member 1524 may overlap one another. For example, as shown in FIG. 16, first ground engaging member 1521 may longitudinally overlap second ground engaging member 1522 in first overlapping region 1531 by a longitudinal overlapping distance 1535. Accordingly, the minimum height of the ground engaging member profile in overlapping region 1531 is indicated by a minimum height dimension 1540. In other embodiments, ground engaging members may be longitudinally abutting one another, such that no overlapping region exists, but no longitudinal gap exists. In such embodiments, the minimum height would be zero or substantially zero at one longitudinal point between the abutting ground engaging members.

While various embodiments of the invention have been described, the description is intended to be exemplary, rather than limiting and it will be apparent to those of ordinary skill in the art that many more embodiments and implementations are possible that are within the scope of the invention. Although many possible combinations of features are shown in the accompanying figures and discussed in this detailed description, many other combinations of the disclosed features are possible. Therefore, it will be understood that any of the features shown and/or discussed in the present disclosure may be implemented together in any suitable combination. Accordingly, the invention is not to be restricted except in light of the attached claims and their equivalents. Also, various modifications and changes may be made within the scope of the attached claims.

What is claimed is:

1. A ground-engaging member for an article of footwear, the ground-engaging member comprising:

a tip surface including a first tip vertex disposed on a first radial axis from an approximate center point of the tip surface, a second tip vertex disposed on a second radial axis from the approximate center point, a third tip vertex disposed on a third radial axis from the approximate center point, a first concave tip edge extending from the first tip vertex to the second tip vertex, a second concave tip edge extending from the second tip vertex to the third tip vertex, and a third concave tip edge extending from the third tip vertex to the first tip vertex;

a first base vertex spaced apart from the first tip vertex and offset from the first radial axis by a first angle;

a second base vertex spaced apart from the second tip vertex and offset from the second radial axis by a second angle; and a third base vertex spaced apart from the third tip vertex and offset from the third radial axis by a third angle.

2. The ground-engaging member of claim 1, wherein the first tip vertex, the second tip vertex, and the third tip vertex are spaced apart from the approximate center point by approximately the same distance.

3. The ground-engaging member of claim 1, wherein the first base vertex is spaced further from the approximate center point a greater distance than the first tip vertex, the second base vertex is spaced further from the approximate center point a greater distance than the second tip vertex, and the third base vertex is spaced further from the approximate center point a greater distance than the third tip vertex.

4. The ground-engaging member of claim 1, wherein the first angle, the second angle, and the third angle are approximately equal.

5. The ground-engaging member of claim 1, wherein at least one of the first angle, the second angle, and the third angle are different.

6. The ground-engaging member of claim 1, further comprising a first lobe extending between the first tip vertex and the first base vertex, a second lobe extending between the second tip vertex and the second base vertex, and a third lobe extending between the third tip vertex and the third base vertex, the first lobe, the second lobe, and the third lobe increasingly deviating in non-radial directions along a height of the ground-engaging member from the first radial axis, the second radial axis, and the third radial axis, respectively.

7. The ground-engaging member of claim 6, further comprising a first sidewall extending between the first lobe and the second lobe, a second sidewall extending between the second lobe and the third lobe, and a third sidewall extending between the third lobe and the first lobe.

8. The ground-engaging member of claim 7, wherein a first outer surface defined by the first sidewall, a second outer surface defined by the second sidewall, and a third outer surfaced defined by the third sidewall are concave.

9. The ground-engaging member of claim 8, wherein the first sidewall defines the first concave tip edge at the tip surface, the second sidewall defines the second concave tip edge at the tip surface, and the third sidewall defines the third concave tip edge at the tip surface.

10. The ground-engaging member of claim 8, wherein the first sidewall defines a first concave base edge between the first base vertex and the second base vertex, the second sidewall defines a second concave base edge between the second base vertex and the third base vertex, and the third sidewall defines a third concave base edge between the third base vertex and the first base vertex.

11. A sole structure incorporating the ground-engaging member of claim 1.

12. An article of footwear incorporating the ground-engaging member of claim 1.

13. A ground-engaging member for an article of footwear, the ground-engaging member comprising:

a tip surface including a first tip vertex disposed on a first radial axis from an approximate center point of the tip surface, a second tip vertex disposed on a second radial axis from the approximate center point, and a third tip vertex disposed on a third radial axis from the approximate center point;

a first base vertex spaced apart from the first tip vertex and disposed on a first non-radial axis;

a second base vertex spaced apart from the second tip vertex and disposed on a second non-radial axis;

a third base vertex spaced apart from the third tip vertex and disposed on a third non-radial axis;

a first lobe extending along a first arcuate path between the first tip vertex and the first base vertex;

a second lobe extending along a second arcuate path between the second tip vertex and the second base vertex;

a third lobe extending along a third arcuate path between the third tip vertex and the third base vertex;

a first sidewall extending between the first lobe and the second lobe and having a first length;

a second sidewall extending between the second lobe and the third lobe and having a second length; and a third sidewall extending between the third lobe and the first lobe and including a third length approximately equal to the second length and different than the first length.

14. The ground-engaging member of claim 13, wherein the third base vertex is spaced apart from the approximate center point a greater distance than the first base vertex and the second base vertex.

15. The ground-engaging member of claim 13, wherein the first tip vertex, the second tip vertex, and the third tip vertex are spaced apart from the approximate center point by approximately the same distance.

16. The ground-engaging member of claim 13, wherein the a first outer surface defined by first sidewall, a second outer surface defined by the second sidewall, and a third outer surfaced defined by the third sidewall are concave.

17. The ground-engaging member of claim 16, wherein the first sidewall defines a first concave tip edge at the tip surface, the second sidewall defines a second concave tip edge at the tip surface, and the third sidewall defines a third concave tip edge at the tip surface.

18. The ground-engaging member of claim 16, wherein the first sidewall defines a first concave base edge between the first base vertex and the second base vertex, the second sidewall defines a second concave base edge between the second base vertex and the third base vertex, and the third sidewall defines a third concave base edge between the third base vertex and the first base vertex.

19. A sole structure incorporating the ground-engaging member of claim 13.

20. An article of footwear incorporating the ground-engaging member of claim 13.

* * * * *